US011480030B2

(12) United States Patent
Angman et al.

(10) Patent No.: US 11,480,030 B2
(45) Date of Patent: Oct. 25, 2022

(54) THERMAL EXPANSION ACTUATION SYSTEM FOR SLEEVE SHIFTING

(71) Applicant: KOBOLD CORPORATION, Calgary (CA)

(72) Inventors: Per Angman, Calgary (CA); Mark Andreychuk, Calgary (CA); Allan Petrella, Calgary (CA); Matthew Brown, Calgary (CA)

( * ) Notice: Subject to any disclaimer, the term of this patent is extended or adjusted under 35 U.S.C. 154(b) by 4 days.

(21) Appl. No.: 16/978,618

(22) PCT Filed: Mar. 5, 2019

(86) PCT No.: PCT/CA2019/050268

§ 371 (c)(1),
(2) Date: Sep. 4, 2020

(87) PCT Pub. No.: WO2019/169490

PCT Pub. Date: Sep. 12, 2019

(65) Prior Publication Data

US 2021/0002977 A1 Jan. 7, 2021

Related U.S. Application Data

(60) Provisional application No. 62/638,850, filed on Mar. 5, 2018.

(51) Int. Cl.
*E21B 34/14* (2006.01)
*E21B 34/16* (2006.01)
(Continued)

(52) U.S. Cl.
CPC ..... *E21B 34/066* (2013.01); *E21B 43/26* (2013.01); *E21B 2200/06* (2020.05)

(58) Field of Classification Search
CPC ..... E21B 34/16; E21B 34/14; E21B 34/066; E21B 2200/06
See application file for complete search history.

(56) References Cited

U.S. PATENT DOCUMENTS 3,233,674 A 2/1966 Leutwyler et al.
4,498,543 A 2/1985 Pye et al.
(Continued)

FOREIGN PATENT DOCUMENTS

CA 2923662 9/2016
CN 106907129 6/2017
(Continued)

OTHER PUBLICATIONS

Written Opinion of the International Searching Authority received in corresponding PCT Application No. PCT/CA2019/050268, published Sep. 12, 2019, 8 pages.
(Continued)

*Primary Examiner* — Kenneth L Thompson
(74) *Attorney, Agent, or Firm* — Parlee McLaws, LLP

(57) ABSTRACT

A thermal expansion system for actuating a remote operated sleeve assembly to open and close ports in a housing for fluidly communicating between a bore of a tubular string in a wellbore to the formation utilizes actuation of a propellant charge to create expanding gas and heat in a combustion chamber to directly act on one side of a piston connected to an axially moveable sleeve supported in the housing to shift the sleeve in one direction. Ignition of another propellant charge in a combustion chamber on an opposing side of the piston is used to directly shift the sleeve in an opposing direction.

13 Claims, 12 Drawing Sheets

(51) Int. Cl.
*E21B 34/06* (2006.01)
*E21B 43/26* (2006.01)

(56) References Cited

U.S. PATENT DOCUMENTS

| | | | | |
|---|---|---|---|---|
| 7,237,616 | B2 | 7/2007 | Patel | |
| 7,743,831 | B2 * | 6/2010 | Bunnell | E21B 34/066 166/57 |
| 7,802,627 | B2 * | 9/2010 | Hofman | E21B 34/14 166/373 |
| 8,397,741 | B2 * | 3/2013 | Bisset | E21B 34/06 137/68.13 |
| 8,839,871 | B2 | 9/2014 | Wright et al. | |
| 10,006,269 | B2 * | 6/2018 | Holder | E21B 34/108 |
| 10,221,656 | B2 | 3/2019 | Barton et al. | |
| 10,435,986 | B2 * | 10/2019 | Holder | E21B 34/14 |
| 10,808,509 | B2 | 10/2020 | Getzlaf et al. | |
| 11,035,203 | B2 * | 6/2021 | Merron | E21B 43/26 |
| 11,111,763 | B2 * | 9/2021 | Shields | E21B 29/02 |
| 2007/0204995 | A1 | 9/2007 | Hofman et al. | |
| 2008/0078553 | A1 | 4/2008 | George | |
| 2013/0284424 | A1 | 10/2013 | Vick, Jr. et al. | |
| 2021/0372212 | A1 * | 12/2021 | Shaffer | E21B 33/1293 |

FOREIGN PATENT DOCUMENTS

| | | |
|---|---|---|
| EP | 3268831 | 11/2018 |
| WO | 2014123539 | 8/2014 |
| WO | 2017027978 | 2/2017 |
| WO | 2018080500 | 5/2019 |

OTHER PUBLICATIONS

English Translation of CN106907129 (see above), published Jun. 30, 2017, 8 pages.

* cited by examiner

I,E
48
76
56
102
104
100
60
62
40
20
28

TABLE E

| | | Combustion Chamber | | | | Compression Chamber | | Large Chamber Pressure | | | | | | Combustion Chamber | |
|---|---|---|---|---|---|---|---|---|---|---|---|---|---|---|---|
| | | Initial Length (in) | Initial Volume (in^3) | Final Volume (in^3) | Max Push Force (lbf) | Length (in) | Volume (in^3) | x 1 Shift | x 2 Shifts | x 3 Shifts | x 4 Shifts | x 5 Shifts | x 6 Shifts | Max Back Pressure (psi) | Max Back Force (lbf) |
| Rod Diameter (in) | 0.25 | 2.0 | 0.10 | 0.20 | 2454.4 | 28.57 | 49.09 | 200 | 400 | 600 | 800 | 1000 | 1200 | 2000 | 490.9 |
| Stroke Length (in) | 2.0 | 2.0 | 0.10 | 0.20 | 2454.4 | 25.40 | 43.63 | 225 | 450 | 675 | 900 | 1125 | 1350 | 2250 | 552.2 |
| Peak Pressure (psi) | 50000 | 2.0 | 0.10 | 0.20 | 2454.4 | 22.86 | 39.27 | 250 | 500 | 750 | 1000 | 1250 | 1500 | 2500 | 613.6 |
| Final Pressure (psi) | 1200 | 2.0 | 0.10 | 0.20 | 2454.4 | 20.78 | 35.70 | 275 | 550 | 825 | 1100 | 1375 | 1650 | 2750 | 675.0 |
| Number of Shifts | 6 | 2.0 | 0.10 | 0.20 | 2454.4 | 19.05 | 32.72 | 300 | 600 | 900 | 1200 | 1500 | 1800 | 3000 | 736.3 |
| | | 2.0 | 0.10 | 0.20 | 2454.4 | 17.58 | 30.21 | 325 | 650 | 975 | 1300 | 1625 | 1950 | 3250 | 797.7 |
| Chamber ID (in) | 4.250 | 2.0 | 0.10 | 0.20 | 2454.4 | 16.33 | 28.05 | 350 | 700 | 1050 | 1400 | 1750 | 2100 | 3500 | 859.0 |
| Chamber Height (in) | 0.25 | 2.0 | 0.10 | 0.20 | 2454.4 | 15.24 | 26.18 | 375 | 750 | 1125 | 1500 | 1875 | 2250 | 3750 | 920.4 |
| Chamber OD (in) | 4.500 | 2.0 | 0.10 | 0.20 | 2454.4 | 14.29 | 24.54 | 400 | 800 | 1200 | 1600 | 2000 | 2400 | 4000 | 981.7 |
| Chamber Area (in^2) | 1.718 | 2.0 | 0.10 | 0.20 | 2454.4 | 13.45 | 23.10 | 425 | 850 | 1275 | 1700 | 2125 | 2550 | 4250 | 1043.1 |
| | | 2.0 | 0.10 | 0.20 | 2454.4 | 12.70 | 21.82 | 450 | 900 | 1350 | 1800 | 2250 | 2700 | 4500 | 1104.5 |
| Rod Area (in^2) | 0.049 | 2.0 | 0.10 | 0.20 | 2454.4 | 12.03 | 20.67 | 475 | 950 | 1425 | 1900 | 2375 | 2850 | 4750 | 1165.8 |
| Shift Force (lbf) | 2454.4 | 2.0 | 0.10 | 0.20 | 2454.4 | 11.43 | 19.63 | 500 | 1000 | 1500 | 2000 | 2500 | 3000 | 5000 | 1227.2 |

*Fig. 20*

THERMAL EXPANSION ACTUATION SYSTEM FOR SLEEVE SHIFTING

CROSS REFERENCE TO RELATED APPLICATIONS

This application claims the benefit of U.S. provisional application Ser. No. 62/638,850, filed Mar. 5, 2018, the entirety of which is incorporated herein by reference.

FIELD

Embodiments taught herein are related to shifting of sleeves downhole and, more particularly, to actuation systems using remotely triggered thermal expansion for remote shifting of sleeves in a wellbore.

BACKGROUND

Controlling flow downhole in an oil and gas well is an established practice in the oil and gas industry. It is well known to run shifting tools downhole to open and close sleeve valves installed deep within casing in the wellbore to control the flow of fluids to and from the wellbore and formation. Similarly, it is known to distribute steam along steam injection wells in Steam Assisted Gravity Drainage operations (SAGD), by pre-determining distribution, or manually shifting valves. Common amongst these operations is a desire for flexibility in the timing and where to control such flows.

In hydraulic fracturing operations, described in more detail below, downhole tools, such as a bottom hole assembly (BHA), are typically run downhole, such as on coiled tubing, to control sleeves in a completion string of casing and can also be used to control the flow of stimulation fluids through open sleeves.

In hydrocarbon operations, plug-and-perforation (plug and perf) systems typically require wireline services and/or coiled tubing (CT) services to run-in-hole (RIH) a select-fire perforating gun with one or more bridge plugs so as to plug and perforate sections of cased horizontal wells for subsequent stimulation operations, such as hydraulic fracturing. This is a time consuming process, often requiring suspension of a frac operation through a previous perforation to move uphole and perforate subsequent sections of the well. This process is then repeated for the number of stimulations desired for the horizontal wellbore. After all the stages have been completed, coiled tubing is typically RIH and used to drill out the plugs for establishing access to the toe of the wellbore. The residual, open perforations cannot be easily blocked off thereafter.

Further, the initial operation of pumping the bridge plug and the perforating guns downhole against a closed lower end, bottom of the well or lower plug, particularly in horizontal completions, can be impeded by trapped fluid and pressure buildup therebelow, particularly for the first stage at the toe end of the well. Sometimes, a costly and separate first wireline trip is required to perforate the first toe stage to permit pumping the apparatus downhole.

Similarly, other downhole operations requiring a BHA run downhole to the bottom of the well can face RIH resistance by trapped fluid below. Particularly challenging are first stage operations that lack fluid release therebelow. Toe subs are known for relieving trapped fluid at least one time at the end of the well.

Characteristic of plug and perf operations, casing integrity pressure testing is often conducted before operations are begun. Pressure actuated tools are used, such as the PosiFrac Toe Sleeve™, available from TAM International, to enable closing of the wellbore for high-pressure testing thereabove without opening the toe sleeve during the test, yet later opening the toe sleeve for frac operations without the need to overpressure above testing pressures. The apparatus and methodology involved can require staged pressure sequences, shear devices and internal metering to enable initial testing in a closed state and subsequent conversion to an open stage. Other available methodologies use a plurality of burst ports, which must accept varied pressure for actuation, sometimes at greater pressures than testing pressures, and once actuated, the reliability and volumetric flow capability may be dependent upon a tricky and simultaneous opening of all ports, rather than bursting just a first port.

In the case of controlling flow along a wellbore, such as hydraulic fracturing, common completion systems for opening and closing sleeves have used conveyance strings such as coiled tubing fit with mechanical shifting tools or dropping actuating objects, such as balls, into the wellbore to seat and shift the sleeve using pressure thereabove. Ball drop technologies are typically limited to a uni-directional downhole action ie—usually to open sleeves in a downhole direction. Conveyed shifting tools such as those conveyed with coiled tubing are now being configured for both opening and closing of sleeves. The conveyed tools also incorporate fluid delivery systems for providing sealing and stimulation fluids, including hydraulic fracturing fluids. Wellbore access, such as with coil tubing, has been, to date, a conventional and necessary expense to sleeve operations.

The sleeves themselves are often internal tubular sleeves having an internal profile for engagement with a co-operating shifting tool, or an internal piston-like sleeve operated using differential pressure created by pressuring up the entire string above a packer. While those sleeves engaged by a shifting tool are being configured more and more for shifting open and shifting closed, shifting tools are characterized by the need for bore-restricting conveyance coiled tubing, and the infrastructure, time and expense for running the shifting tool in and out of the wellbore each time a sleeve is to be shifted.

In one alternative methodology, and avoiding conveyance tubing, sleeves can be opened or closed from surface with umbilical hydraulic lines attached on the exterior of the casing and run to surface from every sleeve. The hydraulic lines are attached to a hydraulic pump/control system for pumping to open or close individual sleeves. Depending upon the design, each sleeve may have its own control line or lines. The fundamental problem with umbilical hydraulic line controlled sleeves is installation logistics. The cost to install the umbilical lines into a well without damage to the lines can be a hindrance. As horizontal wells get longer and longer and the number of stages increases, the number of umbilical control lines required to control every stage may at some point become too unwieldy to be practical.

In yet another sleeve technology, such as that disclosed in U.S. Pat. No. 9,359,859 to Metrol Technology Limited (Aberdeenshire GB), a safety valve is remotely actuated to block all flow up a production well, such as in a blowout situation. Directed to offshore scenarios, a signal is directed to tools in the production string, either through sonar or other wireless signals. The signals are intended to be short distance transmissions, including by locating a remote operated vehicle (ROV) in close proximity to the tool, or using some other wireless waveform in the 1-10 HZ range. Noise reduction is discussed for disseminating the useful actuation signal from background noise. This technology may be limited to offshore and closely spaced transmitters and receivers.

Opening and closing of sleeves has many advantages including, but not limited to, conventional access to the wellbore for fracing operations, for strategic closing of sleeves after fracing for wellbore healing and to mitigate flow back problems, to perform staged production testing and zonal flow control such as to block flooding.

Zonal flow control can be dependent upon knowledge of the flow, not from the well as a whole, but from zones or from sleeves themselves.

Flow control into the well may be useful where incursion of water into a wellbore at a particular zone, such as from a naturally occurring aquifer or a high permeability channel, affects oil production therein. Intervention to close a sleeve valve can be taken once the zone through which the water is entering the well has been identified.

Controlling flow is also typically utilized in an effort to maximize hydrocarbon production from a particular well, stage or group of wells in a field. Reservoir flooding, using water or $CO_2$, is one established example of techniques for maximizing hydrocarbon production using a group of wells which are fluidly connected through the reservoir. Some of the wells are used as injector wells, while other of the wells are used as production wells. The fluid, typically water or gas, is injected into the injector wells to increase reservoir energy and to sweep oil towards the production wells through which the oil is recovered. Often, maximizing reservoir flooding capability is more economical than drilling or fracturing new or existing wells.

Determination of flow patterns in the wells or groups of wells, with the objective of maximizing oil production, is conventionally determined by:

- production logging a well, wherein production logging tools are run-in-hole (RIH) on the end of coiled tubing, jointed tubing or wireline for measuring, for example, rate of flow and/or whether the fluid flowing is gas, liquid, hydrocarbon, water, etc.;
- injection of chemical or radioactive tracers with subsequent detection to determine where the tracers exit the particular well or group of wells; and
- permanent installation of fiber optic or other sensors on the outside or the inside of the casing, with or without sleeve control lines for each sleeve valve in the casing.

Temporary fiber optic lines can be run on wireline or coiled tubing. For example, they can be used to measure well temperature to infer inflow from various stages. Currently, the industry is predominantly using hard line fiber optic systems, where the fiber optic line is run on the exterior or interior of a casing/liner string to measure temperature and vibration at every injection point or stage in a well to infer flow. Measurement and recording of vibration and temperature over time, as well as monitoring of production changes at surface, for example an oil well in which water production increases over time, allows an operator to make judgements and decisions regarding which stage or stages are involved in the increase in water production so that an appropriate intervention can be taken. This is especially the case when the field application is a reservoir flooding application utilizing both injector wells and producing wells.

The challenge presented by conventional methods of flow detection is that, in most cases, the well must be taken off production and intervention is required, which is costly. Further, using permanently installed conventional detection and control systems is costly and logistically complicated. For example, installation of such systems is often hampered by the lack of annular space between production equipment and casing.

There is interest in the industry to develop apparatus and methods to aid in completion operations and in flow control, such as the injection and production of fluids from injection and/or producing wells, particularly in systems which do not require intervention to shift sleeves for controlling flow of fluids to and from the wellbore and for powering or actuating the shifting of the sleeves therein.

BRIEF DESCRIPTION OF DRAWINGS

FIG. 20 is a Table illustrating pressure and force values for various geometries of the compression chamber in an embodiment using rods, such as shown in FIG. 8.

SUMMARY

Figure 1:
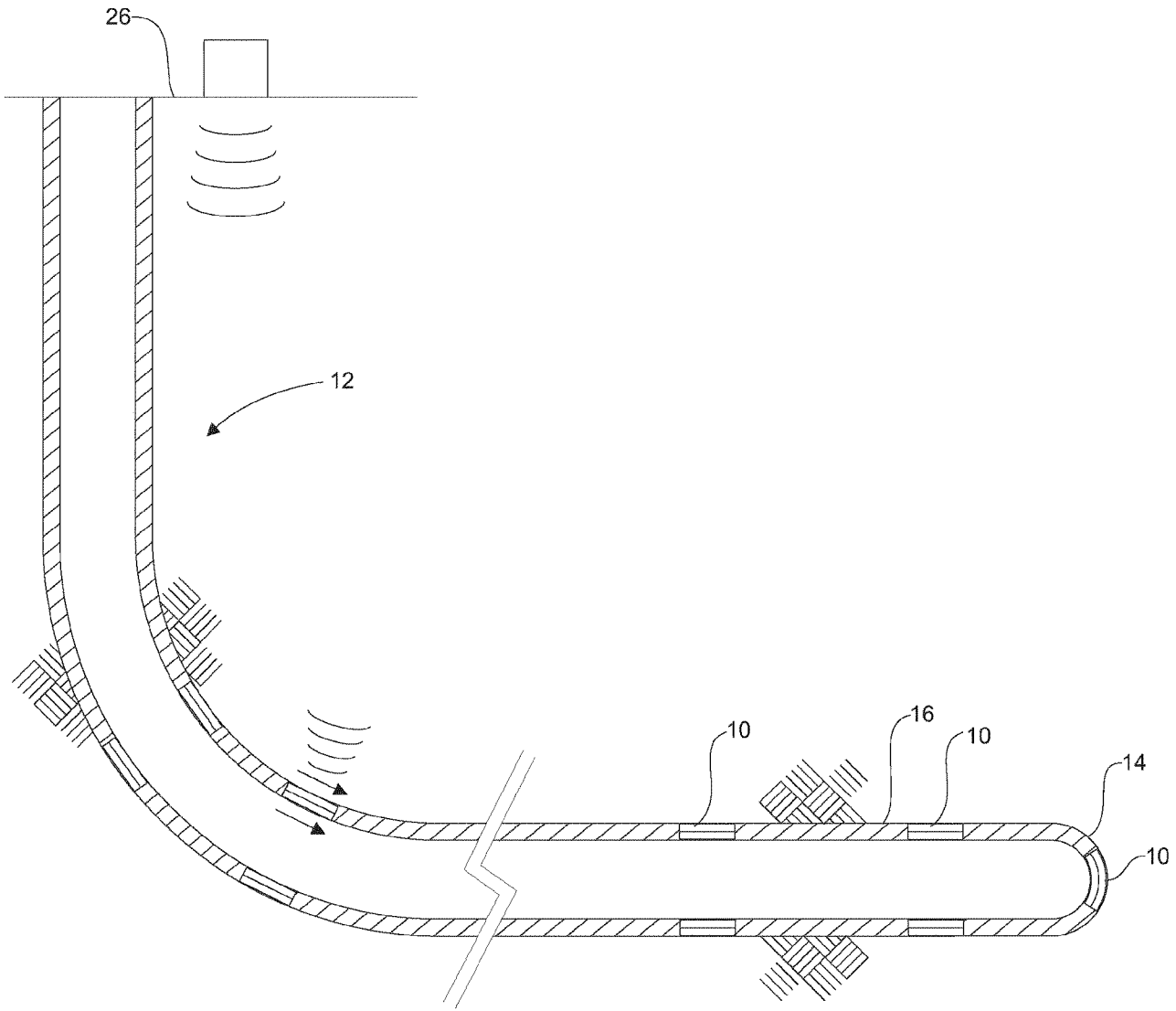
FIG. 1 is a cross-sectional view of a wellbore having a system of remote actuated sleeve assemblies according to embodiments taught herein, installed therein, including a toe sub for actuation by signals sent from surface.

Embodiments taught herein utilize coded signals sent from surface to actuate ignition of an explosive charge of propellant on one side of a sleeve piston to directly shift the piston and sleeve connected thereto in one direction, such as to open a sleeve in a housing in which the sleeve is axially moveable. To shift the sleeve in an opposing direction, such as to open the ports, a charge of a propellant is ignited on an opposing side of the piston for shifting the sleeve in the opposing direction.

In one broad aspect, a remoted operated sleeve assembly comprises a tubular housing having a bore therethrough and ports therein for fluidly connecting the bore to outside the housing and a radially outwardly extending sleeve recess formed intermediate the housing. A sleeve is axially moveably supported in the housing, for shifting between blocking the ports and opening the ports, and forming an annular space therebetween. A radially outwardly extending bidirectional sleeve piston is formed on the sleeve and extending into the annular space into the sleeve recess. A first chamber is formed in the annular space on one side of the sleeve piston and a second chamber formed in the annular space on an opposing side of the sleeve piston. A first circumferential arrangement of a plurality of explosive chambers, are in fluid communication with the first chamber, and a second circumferential arrangement of a plurality of explosive chambers, are in fluid communication with the second chamber, each of the plurality of explosive chambers having a charge of propellant therein. A sensor in the sleeve assembly receives a coded signal for actuating ignition of one or more of the charges of propellant in the first or second circumferential arrangement of the plurality of explosive chambers. Wherein one of the first or second chambers has a volume smaller than a larger volume in the other, the smaller volume chamber forms a combustion chamber and the larger volume chamber forms a compression chamber. Wherein the signal is coded to actuate ignition of one or more of the charges of propellant in the circumferential arrangement of explosive chambers in fluid communication with the combustion chamber, ignition creates at least expanding gas therein for directly acting on the sleeve piston for shifting the piston and the sleeve attached thereto in the direction of the compression chamber. Wherein shifting the sleeve and sleeve piston in the direction of the compression chamber causes the combustion chamber to increase in volume to become a current compression chamber and the compression chamber to decrease in volume to become a current combustion chamber for a subsequent ignition of one or more of the charges of propellant on the opposing side for shifting the sleeve in the opposing direction.

In another broad aspect, a method for remotely shifting a sleeve assembly in a tubular string deployed in a wellbore, the sleeve assembly having a housing and a sleeve axially moveable in the housing and having an annular piston formed thereon extending into an annular space between a housing and the sleeve, comprises: sending a coded signal from surface; and receiving the coded signal at the sleeve assembly, the coded signal actuating ignition of a charge of propellant directly in communication with a combustion chamber on a first side of the piston for shifting the sleeve in one direction.

To return the sleeve in an opposing direction, the method is repeated by actuating ignition of a charge of propellant directly in communication with a combustion chamber on an opposing side of the piston for shifting the sleeve in an opposing direction.

Embodiments of the RO sleeve assemblies and actuation systems disclosed herein can be used in cemented liners or in openhole scenarios. The RO sleeves can be used as toe subs, as production sleeves in production tubular strings and wherever mechanical, RFID or electric shifted sleeves are currently in use.

Embodiments taught herein provide advantages over conventional sleeves, such as those actuated by ball drop:

- if one stage screens out another sleeve can be opened below to displace the frac below the next stage in sequence uphole, assuming the stage that has screened out is above the toe stage, whereas in ball drop systems the operation must be stopped until a clean out is performed;
- have no ball seats to be milled out;
- can be opened and closed;
- require no well intervention
- require no intervention during production as sleeves can be opened and closed at random, including using random trial and error to resolve injection/production flow issues;
- pinpoint entry to the reservoir whereas ball drop systems with open hole packers cannot do this;
- can use in unlimited number of stages.

Embodiments taught herein provide advantages over conventional sleeves, such as in CT activated sleeves or known RO sleeve assemblies:

- no CT intervention is required;
- no time is lost during sleeve shifting as a result of CT manipulation and cycling in and out of the well or between stages;
- unlimited stages and depths; and
- improved economics compared to other RO sleeve assemblies.

Embodiments taught herein provide advantages over conventional Plug and Perf operations:

- provide pinpoint entry to the reservoir;
- require no bridge plugs to be milled out;
- eliminate use of CT or wireline rigs as intervention is not required;
- if one stage screens out another sleeve can be opened below to displace the frac below the next stage in sequence uphole, assuming the stage that has screened out is above the toe stage, whereas in plug and perf the operation must be stopped until a clean out is performed; and
- can be used in an unlimited number of stages and unlimited depth.

Overall embodiments are advantageous as the inner bore of the sleeve assemblies taught herein is substantially the same as the bore of the tubular string in which the assemblies are deployed. Further, any number of sleeve assemblies can be actuated to open at the same time permitting stimulation therethrough substantially simultaneously.

DETAILED DESCRIPTION

Embodiments taught herein are directed to a unique power or actuation system utilizing thermal expansion for shifting of remote operated (RO) sleeves in a wellbore, without the need to use a conveyance string such as wireline or coiled tubing (CT).

Embodiments taught herein are applicable for use with a wide variety of communication systems to remotely trigger shifting of the remote operated sleeve assemblies between open and closed positions as a result of thermal expansion, such as from ignition of explosive materials, to shift downhole sleeves in the RO sleeve assemblies are described herein. The RO sleeve assemblies are described generally in the context of triggering the actuation using exemplary communication systems, as taught by Applicant in PCT application PCT/CA2016/050974, published as WO 2017/027978, which is incorporated herein in its entirety. Embodiments of the actuation apparatus and systems taught herein can replace the hydraulic systems as described therein.

Applicant's Prior Art Remote Operated Sleeve System (WO 2017/027978)

Remote Operated Sleeve Assemblies

Applicant has taught, in published application WO 2017/027978, a system of remote operated RO sleeve assemblies and communication for triggering the actuation of the RO sleeve assemblies to shift sleeves therein to open and close ports in a wellbore tubular.

The sleeves are opened and closed without the need for a separate actuation tool. The RO sleeve assemblies are coded with a unique code for enabling targeted remote actuation. Using remote and wireless communication for actuation, the RO sleeve assemblies eliminate the need for object-drop technologies, hydraulic umbilical lines, wireline, pressure manipulation and expensive and time consuming entry and re-entry with coiled tubing conveyed tools. The RO sleeve assemblies enable control of fluid communication between the bore of the tubular string, such as casing or a liner, to outside the string, such as to the formation. The RO sleeve assemblies can be used for stimulating the formation by flowing fluid out to the formation or for controlling flow of fluids from the formation into the tubular string for production to surface. As neither wireline nor CT is required to be run into the tubular string to actuate shifting of the sleeves, the bore of the tubular string is unimpeded during such wellbore operations.

In embodiments, as shown in FIG. 1, one or more RO sleeve assemblies 10, generally a plurality of the sleeves assemblies 10 for fracturing operations, are disposed in a wellbore 12. One or more RO sleeve assemblies 10 can be disposed in the wellbore 12 at the toe 14 of a string of well tubulars 16, such as a casing completion string, a production string or an injection string, and/or at intervals along the string of well tubulars 16. The one or more sleeve assemblies 10 are fit with means for remote operation. Thus, without tool actuation apparatus impeding a bore 18 of the well tubulars 16, an operator can selectively choose to open and close RO sleeve assemblies 10, such as through remote wireless communication. Communication can include, but is not limited to, electronic means, including RFID, or wireless and acoustic means, including seismic, or fluid pressure pulse transmission and the like.

In basic implementation, the communication need only provide an open and close signal, achieving a threshold suitable to be distinguishable at the sleeve for actuation, such a binary communication being substantially impervious to noise, and thus false positives and unintended actuation. Optionally, the signal can include a code for unique actuation of a corresponding and unique RO sleeve assembly 10 of a plurality of RO sleeve assemblies 10. Again, the signal can be binary or rendered as binary to avoid noise considerations.

Each prior art RO sleeve assembly 10 can be equipped with a power source, a signal receiver and an actuating device for opening, for closing or for both opening and closing an RO sleeve assembly 10. A signal, transmitted from surface, is received by signal receiver of the intended RO sleeve assembly or assemblies 10, which triggers the actuating device for opening or closing the intended RO sleeve assemblies 10. The RO sleeve assemblies 10 can be opened or closed once, depending upon the sleeve state when RIH, or can be opened and closed a number of times, as required and as described herein.

In embodiments, each prior art RO sleeve assembly 10 comprises a tubular housing connected to the string of well tubulars, such as at the end of the tubular string, or intermediate thereof. Each tubular housing has a bore therethrough, fit with an internal, hydraulic-actuated sleeve, that is axially movable back and forth therein to alternately close and open ports in the tubular housing, for fluid communication through the housing, such as between the tubular bore and outside the housing. The sleeve forms a valve chamber between the tubular housing and the sleeve.

In an embodiment, the sleeve of the RO sleeve assembly taught in Applicant's published application WO 2017/027978 is hydraulically actuable from the axial ends of the sleeve, and in another embodiment, the sleeve is fit with an annular shoulder thereabout that is sealable along the valve chamber forming a bi-directional piston. The internal, hydraulic-actuated sleeve is a bi-directional sleeve, having a downhole actuation chamber on the uphole side of the piston and an uphole actuation chamber on the downhole side of the piston. The uphole and downhole actuation chambers are in communication with an actuating valve. The valve is fluidly interposed between the tubular bore (a source of pressure) and one side of the bi-directional valve chamber. Another valve, or the same valve, is also fluidly interposed between a dump chamber (an accumulator) and the opposing or second side of the bi-directional valve chamber. The valve alternates between driving and dumping each side as it moves back and forth. As known in hydraulic ram technology, a two-position hydraulic valve can simultaneously communicate to both sides of the piston for opposing fluid functions, one to drive the piston, the other to received displaced dump fluid.

Upon receipt of a triggering signal the valve is actuated to establish a driving pressure between the one side of the sleeve chamber and the bore for opening or closing the sleeve depending on the hydraulic coupling arrangement. The other side, also connected through the valve, dumps previous or spent driving fluid to the accumulator. Shifting of the two position valve, or coordinated actuation of two separate valves, the process can be operated in reverse to close or open the sleeve, opposite in actuation to the prior actuation. The accumulator is preferably at a sufficient pressure differential, and having sufficient volume, for multiple operations before the accumulator pressure differential falls below useful levels. In an embodiment, the accumulator is initially at atmospheric pressure.

Communication

Communication of a signal from surface is used to actuate the RO sleeve assemblies, enabling operation free of shifting tools or wired or hydraulic connection to surface. Such wireless communication includes signals embedded in electronic, acoustic (herein, the term acoustic is used generally to include seismic body waves both P- and S-waves transmitted through the formation, or any wave form transmitted through the casing, including but not limited to P-waves, S-waves, elastic waves and the like), or fluid pressure pulse transmission. The communication signal transmitted from surface is received by the sleeve and triggers the actuating device for opening or closing the sleeve.

It is known in the art, such as taught in U.S. Pat. No. 9,284,834 to Schlumberger to provide electronic communication from deep in a well to surface or between locations in the well. Information including downhole temperature, pressure, fluid flow, and viscosity may be obtained by memory tools downhole, in which information and data from the tools and assembly may be recovered later after the tools have been retrieved back at the surface. However, if the recorded data is corrupt or insufficient, such a failure may not be apparent until after the tools have been retrieved back at the surface. Further, other testing methods such as running a cable from the surface to the data recording tools are troublesome in that it could obstruct fluid flow and be easily damaged. Electromagnetic or acoustic wireless signals may be used for shorter range applications, such as transferring data within and between adjacent downhole tools, commonly referred to as the "short hop section" and longer range applications, such as transferring data between the downhole tools and the surface are commonly referred to as the "long hop section." For long distances, a long hop section may be used to receive the data signals from the short hop section and re-transmit the signals at a higher level and/or higher power. Further, for long distances, such as to surface, repeaters may be used to provide communication between the short hop sections and the long hop sections.

Such systems are complex, and intended to manage comprehensive data to effect, control or modify operations or parameters. A multiplicity of components are required, any of which are subject to failure.

Instead, effective communication between the surface and the RO sleeve assemblies can be achieved at a very low baud rate. Simply, each RO sleeve assembly need only know it has received a signal to actuate. Further, a low transmission rate, as low as one bit per second, is sufficient to be distinguishable as an actuation signal yet is noise tolerant and can represent more than a billion possible unique codes to actuate a specific RO sleeve assembly, such as for a 30 second transmission. An amplitude of whatever signal is transmitted is sufficient to exceed a threshold during a pre-defined window length. Applicant has determined that an acoustic signal, such as that from a hammer blow at the wellhead at the surface, is easily detectable at a downhole sleeve, above the background noise, and detectable even at the toe of a horizontal well, often some 2500 meters away.

RO sleeve assemblies can be coded with identities for targeted operation, individual operation or in a sequence, or the operation of many sleeves en masse. Coding could be specific for opening and closing each sleeve therein individually in each well of a specific field. In more detail, the solution provided herein, provides one or more RO sleeves assemblies that eliminate umbilical lines to activate sleeves between open and closed positions. Each RO sleeve assembly, having a receiver powered by a battery, receives communications from surface. There need not be return communication to surface from the RO sleeve assemblies. A signal is sent from surface to the RO sleeve assemblies and the sleeve therein is actuated to either open or close.

The signal can be sent from surface, such as via mud pulse, electromagnetic, acoustic, vibration, radio frequency, or conveyed trigger such as an RFID, to trigger a particular sleeve. Each RO sleeve assembly has a receiver that decodes the transmitted signal for that specific RO sleeve assembly and the RO sleeve assembly reacts to the command to open or close.

Further, the energy of the opening or closing of the RO sleeve assembly can be detected at surface such as through wellhead vibration, acoustics, fluid transmission, or through pressure response of a well.

Signals are communicated, at least from surface, to actuate the remote operated sleeve assemblies located in a wellbore, as described above. The signals are communicated to a tool actuator to operate the tool as desired. Further, communication systems do not require two-way communication to actuate the tool. Generally, only one-way communication from surface is sufficient for tool actuation.

In embodiments taught in published application WO 2017/027978, Applicant teaches embodiments using the following technologies to send code to the RO sleeve assemblies:

- wellhead percussion or impact pulses, wherein apparatus, such as a hammer of a control module, impacts the wellhead in a specific code sequence, the code sequence being transmitted through the wellhead and tubulars connected thereto to the actuator of the RO Sleeve; and
- seismic communication or vibration, wherein a seismic vibrator is located at surface to transmit a configured sequence of vibrations through the earth to the actuator of the RO sleeve assemblies.

Using the wellhead percussion or impact pulse system, the control module (CM), capable of applying percussive coded signals, is bolted to a wellhead, such as to a casing flange. The CM is powered such as by a cable connected from the CM to a pickup truck located onsite.

In operation, a unique pre-programmed code for a specific RO sleeve assembly is sent manually or through a wireless device, such as a cell phone, to a power pack for the CM mounted on the wellhead. The CM power pack powers and sends a command to the CM to percussively send the coded signal downhole through the casing to the specific RO sleeve assembly. The coded signals sent by the CM, as measured by a wellhead sensor and received at the RO sleeve assembly can be measured by a Frac Imaging Module (FIM), such as taught in Applicant's US published patent application 2015-

0075783 and in U.S. patent application Ser. No. 14/405,609, both to Kobold Corporation. It has been observed that a perceptible bump or increase in pressure, when the sleeve shifts, can be seen in the FIM data. The coded signal is less evident in the FIM data than when cross-correlated to the pattern of the coded signal.

The RO sleeve assemblies decode the signal containing an instruction, such as to open. Embodiments which utilize seismic vibration to provide coded signals to actuate tool operation are substantially identical to those which use wellhead percussion with the exception of the source of the coded signals.

A seismic vibrator is towed and positioned at surface adjacent the wellbore. Generally, for practical reasons such as access, the vibrator is positioned on the same leased land as was used to drill and fracture the wellbore. The seismic vibrator is used to provide a coded signal as described for opening a sleeve downhole. The vibrator signal is detectable downhole using the FIM tool during pumping of the frac. Similar to the impact signals, the vibrator signature is not obvious in the raw FIM data, however it is apparent in the cross-correlation.

Shock waves generated by the sleeve shifting open or closed are readily detectable at surface using a 3-component sensor attached to the wellhead.

Embodiments of a Thermal Expansion System for Sleeve Shifting

In embodiments of remote operated sleeve assemblies taught herein, actuator systems are taught using explosive actuation creating thermal expansion to shift the sleeve between open and closed positions. Communication to trigger ignition of explosive materials used in embodiments taught herein can be accomplished using a variety of methods, including the methods described in WO 2017/027978 and above and thus, are not described in any great detail below.

In embodiments taught herein, an annular, bidirectional sleeve piston is formed on a sleeve, axially moveable within the RO sleeve assembly 10. The bidirectional sleeve piston extends radially outwardly from the sleeve into an annular space, between the sleeve and a housing in the case of a two-part assembly, or into the annular space, between an inner member and an outer member in which the sleeve is axially moveable, in the case of a three-part sleeve assembly, such as an OptiPort™ sleeve, available from Baker Hughes of Houston, Tex. The bidirectional sleeve piston extends radially outwardly from the sleeve to the housing or outer member for dividing the annular space into first and second chambers therein. Circumferentially arranged explosive charges are located on either side of the bidirectional piston and are ignited sequentially, first on one side and then on the other side and repeated, for directly shifting the piston axially between open and closed positions.

The first and second chambers alternate in function between acting as a current combustion chamber, for receiving gas and heat generated by ignition and explosion of one or more of the explosive charges, or a current compression chamber for receiving the shifted bidirectional sleeve piston therein, depending upon which direction the sleeve is being shifted.

Prior to shifting the sleeve, the combustion chamber, being the chamber adjacent the charge to be fired, has a volume that is lower than the volume of the compression chamber on the opposing side of the bidirectional sleeve piston. After the sleeve piston has shifted into the current compression chamber, the volume therein is reduced and becomes the combustion chamber for a subsequent firing of a charge on the opposing side for shifting the sleeve in the opposite direction. The combustion chamber increases in volume as the sleeve piston shifts into the compression chamber and becomes the compression chamber, as described below.

As will be appreciated, according to Boyles Law, following ignition of the explosive charge large amounts of heat and gas are generated into the current compression chamber to which the charge is directly connected. The gas expands rapidly, increasing the pressure in the current combustion chamber and causing the piston to be shifted away. Thereafter, the gases cool rapidly and the pressure drops therein. Further, the volume of the combustion chamber is also enlarged as a result of the shifting of the piston which further aids in lowering the pressure therein and the combustion chamber becomes the current compression chamber for a subsequent firing. While the pressure becomes lower as a result of the cooling, the pressure does not lower to the pre-explosion pressure as a result of the residual gas and pressure resulting therefrom that is retained therein. Ignition of an opposing charge, in the now current combustion chamber on the opposing side of the piston, resulting from the piston shift, must therefore generate sufficient force to overcome the current pressure in the current compression chamber.

In embodiments, the first and second chamber volumes and opposing charge sizes are designed so that the piston and sleeve attached thereto can be shifted at least once between the closed and open positions, such as for use in a toe sub. Further, adjusting the size of the charge permits additional shifting cycles between open and closed positions. Although not shown, if dimensionally possible, increasing the size of the compression chamber also acts to lower the residual pressure therein and permits additional shifting cycles.

In other embodiments, to increase the number of shifting cycles, the residual pressure in the current compression chamber can be decreased by bleeding at least a portion of the gases present therein, following one or more shifting cycles, to a dump or exhaust chamber within the RO sleeve assembly or elsewhere within the tubular string.

In other embodiments, opposing circumferentially arranged intermediary rods are used in explosive chambers carrying the charge, the rods acting as pistons therein to transfer the force created as a result of the explosive event to the sleeve, for shifting of the sleeve.

Embodiments Having Opposing Intermediary Rods

Figure 2:
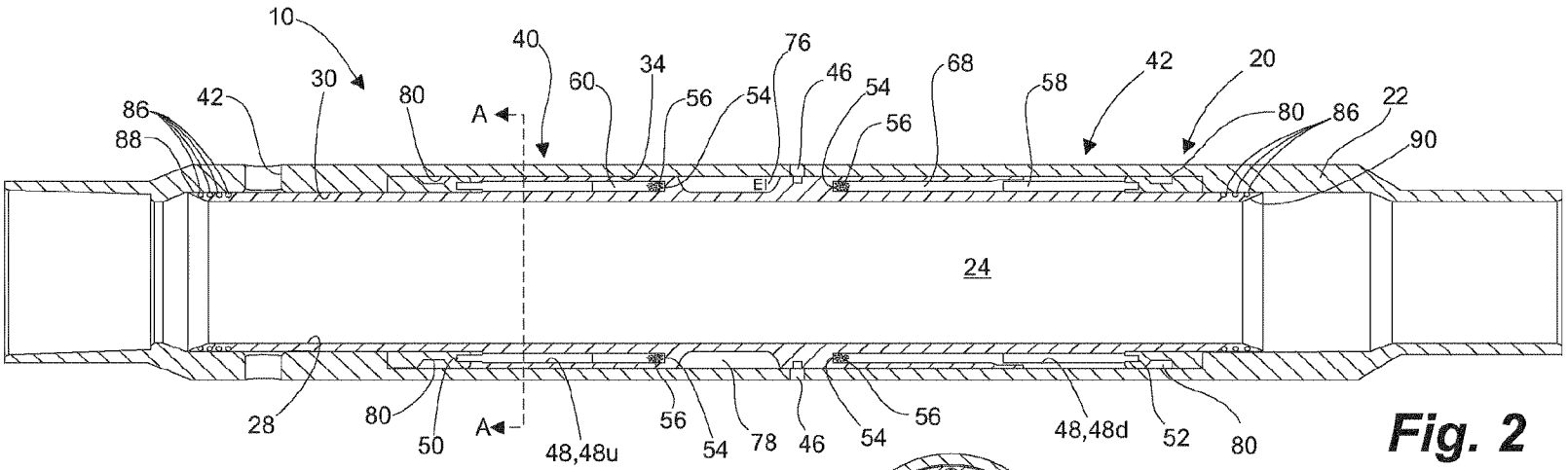
FIG. 2 is a cross-sectional view of a remote operated sleeve assembly, according to an embodiment taught herein, shown in a closed position, having circumferentially arranged uphole and downhole push rods in chambers containing explosive propellant formed in a sleeve, for shifting the sleeve therein to an open position.
Figure 4:
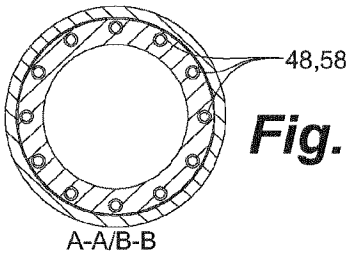
FIG. 4 is a cross-section along lines A-A and lines B-B of FIG. 2 illustrating the circumferential arrangement of explosive chambers therein.
Figure 3:
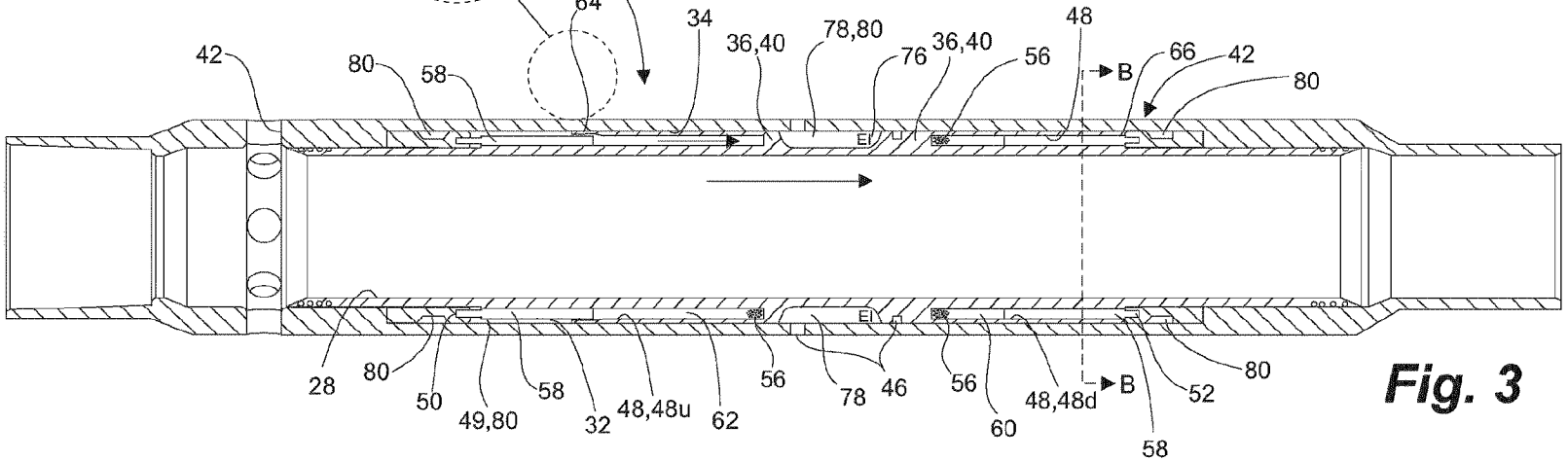
FIG. 3 is a cross-sectional view of the remote operated sleeve assembly of FIG. 2, the sleeve having been shifted to the open position for opening ports in the housing.

In an embodiment, as shown in FIGS. 1 to 3, the RO sleeve assembly 10 comprises a tubular housing 20 having a cylindrical wall 22 and an axial bore 24 therethrough. The tubular housing 20 is fluidly connectable to the tubular string 16, such as a casing string (FIG. 1) at a downhole end 14, such as in a toe sub and/or intermediate thereof, such as in a plurality of axially spaced sleeve assemblies 10 used for wellbore stimulation, such as fracturing, production or in an injection string, such as for SAGD. The tubular string 16 extends to surface 26, perhaps through intermediate and surface casing, all of which is deemed the tubular string 16. The axial bore 24 of the tubular housing 20 is fluidly contiguous with the tubular string 16.

The tubular housing 20 supports an inner cylindrical sleeve 28, movable axially along an inside wall 30 of the tubular housing 20 forming an annular space 32 therebetween. The sleeve 28 is sealably movable along the wall 30 and does not interfere substantially with the axial bore 24. A sleeve recess 34 is formed annularly from the bore 24 and into the wall 30 for accommodating at least a radially outwardly extending thick wall portion 36 of the sleeve 28 formed intermediate a length thereof for forming a bidirectional piston 40. The sleeve recess 34 has a length sufficient to allow the sleeve 28 to shift to cover ports 42 in the housing 20 in a closed position (FIG. 2) and to uncover the ports 42 in an open position (FIG. 3). The thick wall sleeve portion 36 accommodates opposing uphole and downhole explosive actuation apparatus 40, 42 therein, effectively forming the bidirectional piston 40 in the sleeve 28.

The sleeve 28 is typically retained initially to the housing 20 when run-in-hole (RIH), in the closed position, using a retainer 46, such as a shear screw.

As shown in FIGS. 2 to 5, the thick wall sleeve portion 36 has a plurality of circumferentially spaced (FIG. 4) explosive chambers 48 extending axially therein from an uphole end 50 and a downhole end 52 of the housing 20 respectively, forming uphole explosive chambers 48*u* and downhole explosive chambers 48*d*. A terminal end 54 of each of the uphole and downhole explosive chambers 48*u*,48*d*, terminating intermediate the sleeve 28, is closed. Each of the uphole and downhole explosive chambers 48*u*,48*d* is at least partially filled with a charge of explosive propellant 56, such as an explosive material that decomposes rapidly on detonation; that rapidly releases heat and large quantities of high pressure gases and that expands rapidly with sufficient force to overcome confining forces, adjacent the terminal end 54 thereof that can be ignited for shifting the sleeve 28

In this embodiment, each of the explosive chambers 48*u*,48*d* further comprises a push rod 58 which is fixed to and extends axially from the housing 20 into the chamber 48, locating the propellant 56 between the push rod 58 and the closed terminal end 54 in the explosive chamber 48. When the propellant 56 is ignited, pressure, created by the expanding hot gases, acts in the chamber 48 at the push rod 58 and the sleeve 28 is propelled axially away therefrom.

As shown in FIG. 2, with the sleeve 28 in the closed position, the uphole explosive chambers 48*u* in which propellant 56 is to be ignited for shifting the sleeve 28 to the open position (FIG. 3) has a smaller volume than the opposing downhole explosive chambers 48*d*. In this example, the uphole explosive chambers 48*u* act as current combustion chambers 60, while the larger downhole explosive chambers 48*d* acts as current compression chambers 62 for receiving the sleeve therein when shifted to the open position. When one or more of the charges of propellant 56 are signaled to ignite, the heat and gases produced therefrom expand within the current combustion chamber 60, which act against the closed terminal end 54 thereof for propelling the sleeve 28 from the closed position (FIG. 2) to the open position (FIG. 3).

As can be seen in FIG. 3, in the open position, and in preparation for shifting to the closed position (FIG. 2), the now larger volume uphole explosive chambers 48*u* now act as the current compression chambers 62 for receiving the sleeve 28 therein when shifted to the closed position, while the now smaller volume downhole explosive chambers 48*d* act as the current combustion chamber 60 for ignition of one or more of the charges in the opposing downhole explosive chambers 48*d*.

In embodiments, the explosive propellant 56 can be ignited mechanically or electrically, such as in response to the remote actuation signal, coded for each of the explosive chambers 48.

When the sleeve 28 is in an initial, closed position when RIH (FIG. 2), the propellant 56 in one or more of the uphole explosive chambers 48*u* is ignited for overcoming the retainer 46 to initially shift the sleeve 28 from the initial, closed position to the open position (FIG. 3). Thereafter, the sleeve 28 can be shifted uphole to the closed position by ignition in one or more of the downhole explosive chambers 48*d*. The unignited propellant 56 in the remaining of the explosive chambers 46*u*,46*d* can be used at any time thereafter to cycle the sleeve 28 between the open and closed positions as desired.

When the sleeve 28 shifts, the force at which the sleeve 28 is propelled causes the sleeve 28, engaging the housing 20 at both the open and closed positions, to create an acoustic event which travels up the tubular string 16 to surface 26 where it is detected, such as at a wellhead, confirming the shifting of the sleeve 28.

Figure 5:
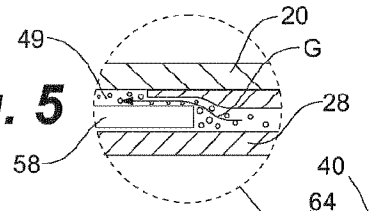
FIG. 5 is a detailed cross-sectional view of a portion of FIG. 3 shown in a dotted circle, illustrating a vent end of the explosive chambers and the rod therein for releasing of gas from the explosive chamber after the sleeve has been fully shifted

Best seen in FIG. 5, an uphole vent end 64 of the uphole explosive chamber 48*u* and a downhole vent end 66 of the downhole explosive chamber 48*d* have an inner diameter that is greater than an outer diameter of the push rod 58. When the sleeve 28 has fully shifted to the open or closed position, the push rod 58 is located in the uphole or downhole vent end 64,66 of the respective uphole and downhole explosive chambers 48*u*,48*d*, which permits the combustion gases G therein to vent from the explosive chambers 48*u*,48*d* as a result of the differences in diameters thereat, such as to an annular gallery 49 fluidly connected to the explosive chambers 48.

Having reference to FIGS. 6A to 7B and in an alternate embodiment using push rods 58 effectively as intermediary pistons, the opposing uphole and downhole push rods 58 are not connected to the housing 20. Instead, as shown schematically, the push rods 58 are moveable within the explosive chambers 48. The terminal ends 54 of the explosive chambers 48 are located away from the bidirectional sleeve piston 40, while an open end 68 of the explosive chamber is adjacent the annular space 32 in which the bidirectional piston 40, extending radially outwardly from the sleeve 28, extends. The propellant is located adjacent the terminal end 54 and the smaller volume combustion chamber 60 is formed in the explosive chamber 48 between the rod 58 and the terminal end 54. The larger volume compression chamber 62 is the annular space 32 on the opposing side of the piston 40.

Figure 7A:
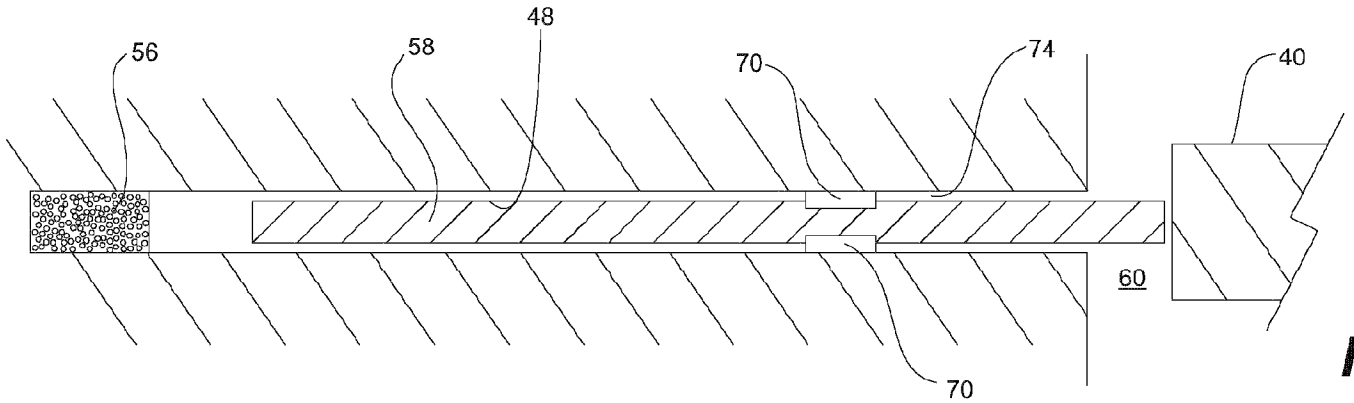
FIGS. 7A and 7B are detailed schematic views of an explosive chamber according to FIGS. 6A and B, and illustrating a sacrificial seal for sealing the rod in a chamber prior to being fired and for removal in a chamber in which the propellant has been fired.
Figure 7B:
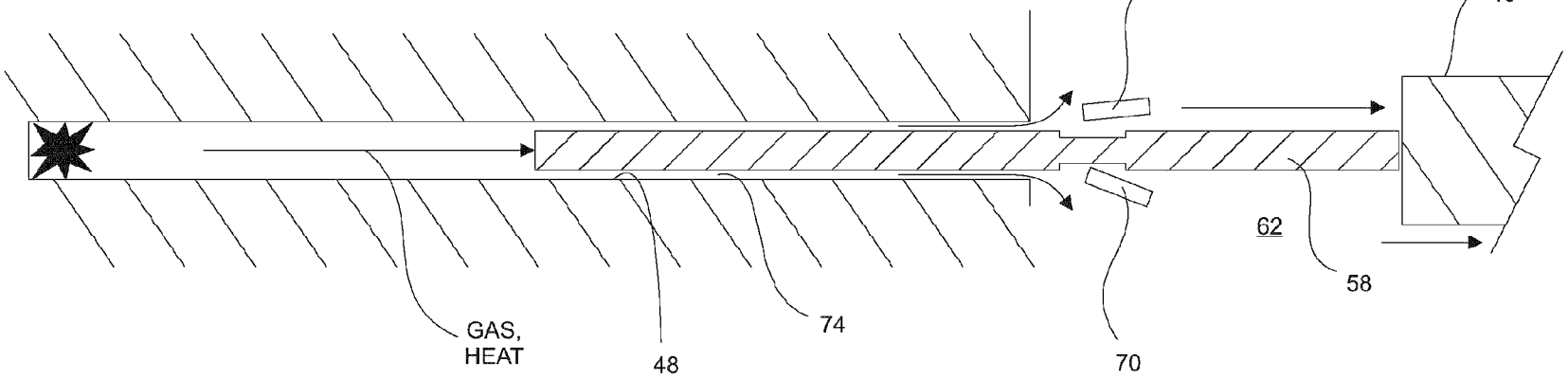

Best seen in FIGS. 7A and 7B, and in an embodiment, the push rods 58 are sealingly fit to the explosive chambers 48, using a sacrificial seal 70, such as an O-ring. The current combustion chamber 60 having a lower volume than the opposing current compression chamber 62 (not shown) permits an end of the rod 72 adjacent the open end 68 thereof to protrude therefrom into the current combustion chamber to engage or abut the bidirectional piston 40. The rod 58 and the bidirectional sleeve piston 40 effectively work together when the propellant 56 is ignited in one or more of the explosive chambers 48, for directly shifting the sleeve 28 in the direction the push rods 58 are propelled.

The charge of propellant 56 is located between the terminal end 54 of the explosive chamber 48 and the push rod 58. When ignited in response to a received signal, the gas and heat produced, propels the rod 58 in the direction toward the piston 40 and the rod 58 and the piston 40 move together to shift the sleeve 28.

Further, as the rod 58 is propelled outwardly from the explosive chamber 48 and as the piston 40 is shifting, the rod 58 and the sacrificial seal 70, located along the rod 58, protrude into the current combustion chamber 60 in the annular space 32 As the seal 70 is acted upon by the gases and heat and is destroyed, the seal 70 no longer seals an annulus 74 between the rod 58 and the explosive chamber 48 and at least a portion of the gas freely expands into the current combustion chamber 60, also acting at the piston 40.

At the end of the stroke, when the piston 40 has been shifted, the rod 58 remains engaged within the explosive chamber 48 to prevent misalignment therewith and allow the rod 58 to move back into the spend explosive chamber 48, when the piston 40 is shifted in the opposite direction.

Figure 8:
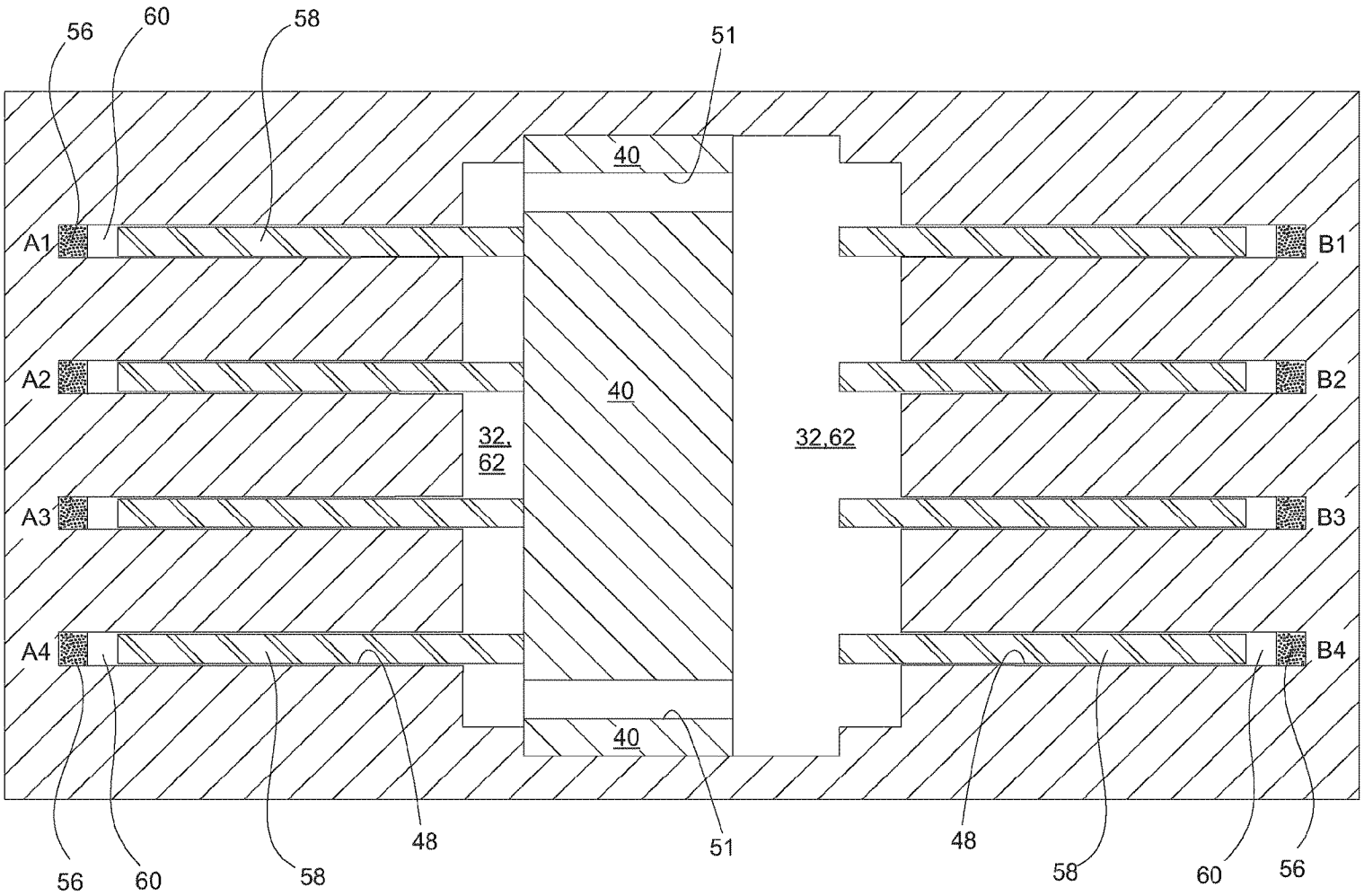
FIG. 8 is a schematic illustration according to FIG. 6B, of an embodiment having passages formed in a sleeve piston for pressure balancing the piston, the sleeve piston and sleeve being shifted by the rod after ignition of the propellant.

In an alternate embodiment, as shown in FIG. 8, the bidirectional sleeve piston 40 further comprises one or more passages 51, either formed through the piston 40, or between the piston 40 and the housing 20 which fluidly connect the annular space 32 on either side of the piston 40 for pressure balancing the sleeve piston 40. In this embodiment, the rods 58 acting as pistons, engage the sleeve piston 40 and apply the force imparted to the rods 58 by the explosive propellant 56 thereto for shifting the sleeve 28. In this embodiment, the explosive chambers 48 act as the combustion chamber 60, while the fluidly connected annular space 32 on both sides of the pressure balanced sleeve piston 40 effectively act as the compression chamber 62.

Sleeve Piston without Intermediary Rods

Figure 9:
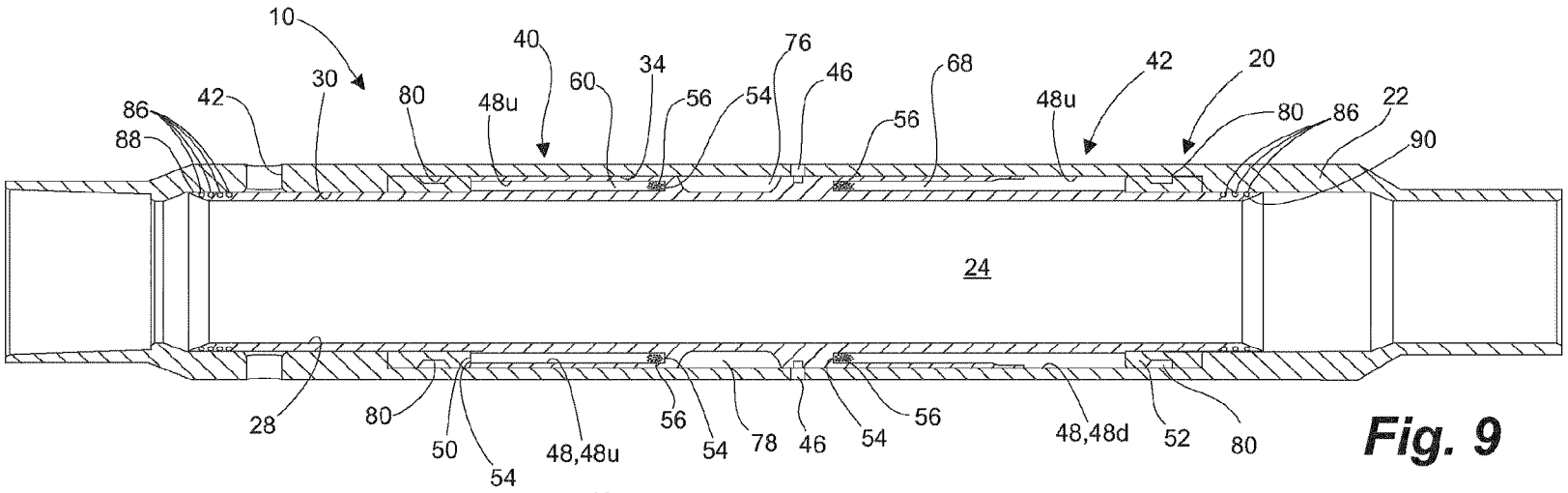
FIG. 9 is a cross-sectional view of a remote operated sleeve assembly, according to an embodiment taught herein, shown in a closed position, having circumferentially arranged uphole and downhole chambers containing explosive propellant formed in a sleeve, without rods, for shifting the sleeve therein to an open position.
Figure 10:
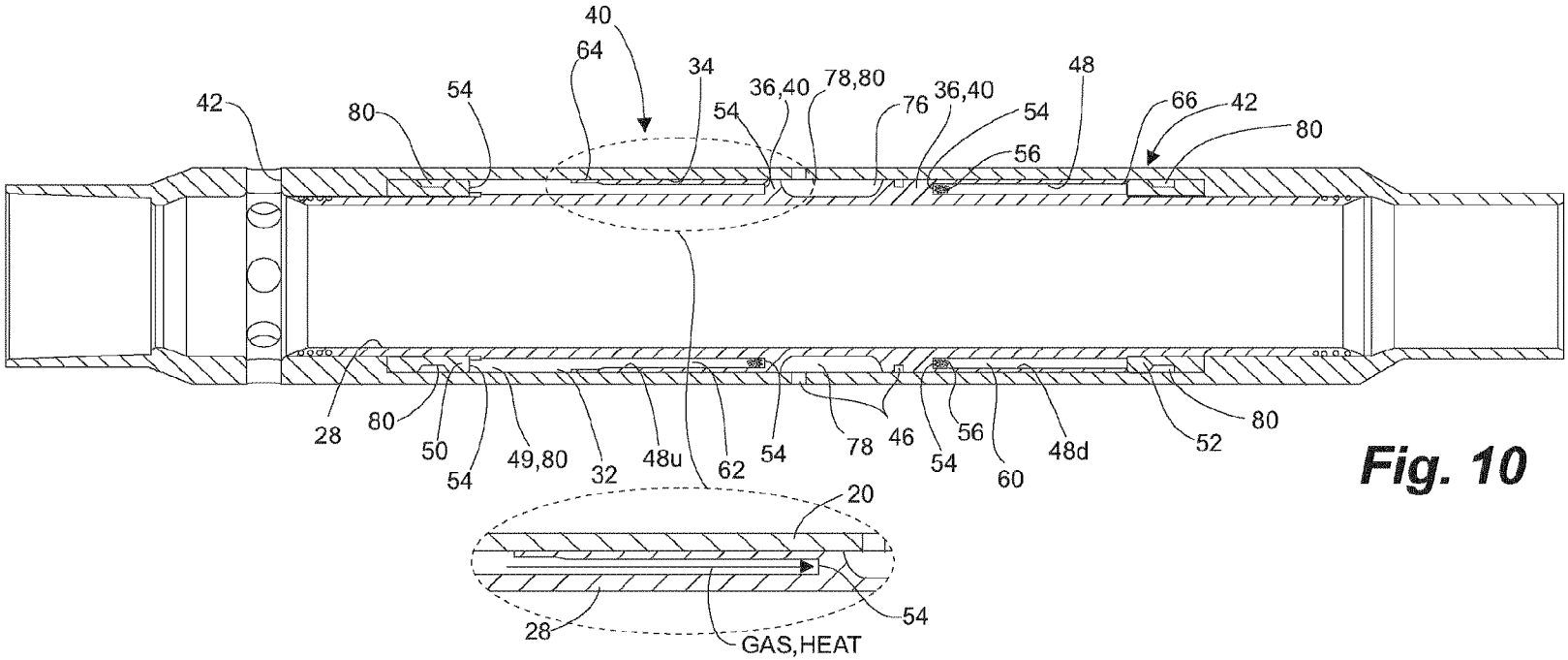
FIG. 10 is a cross-sectional view of the remote operated sleeve assembly without rods, as shown in FIG. 9, the sleeve having been shifted to the open position for opening ports in the housing.

Having reference to FIGS. 9 and 10, in an embodiment similar to that shown in FIGS. 2 to 5, the uphole and downhole explosive chambers 48*u*,48*d* do not include push rods 58. In this embodiment, it is contemplated that a greater charge of explosive propellant 56 may be required in each chamber 48 to shift the sleeve 28.

In the case of the embodiment shown in FIGS. 9 and 10, the gases and heat produced by the propellant 56, when ignited, act against the terminal ends 54 at each end of the explosive chambers 48 however as the sleeve 28 is moveable relative to the stationary housing 20 installed into the stationary tubular string 16, the sleeve 28 shifts.

Figure 11A:
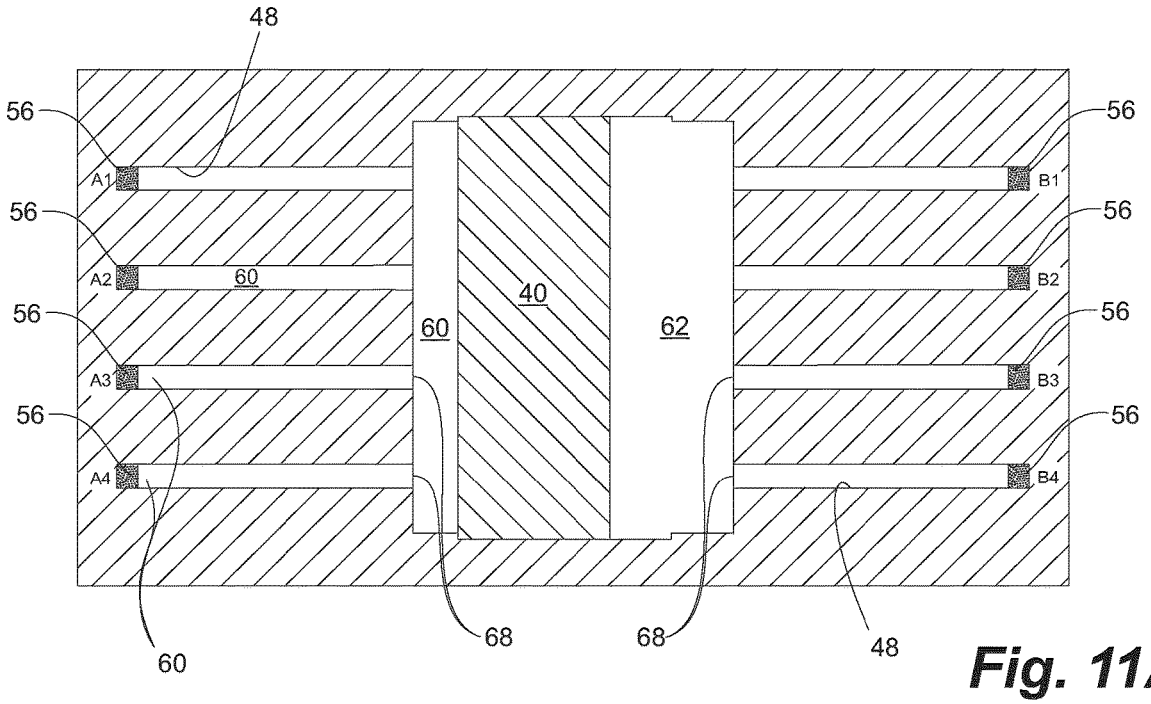
FIGS. 11A and 11B are schematic illustrations of another embodiment without rods.
Figure 11B:
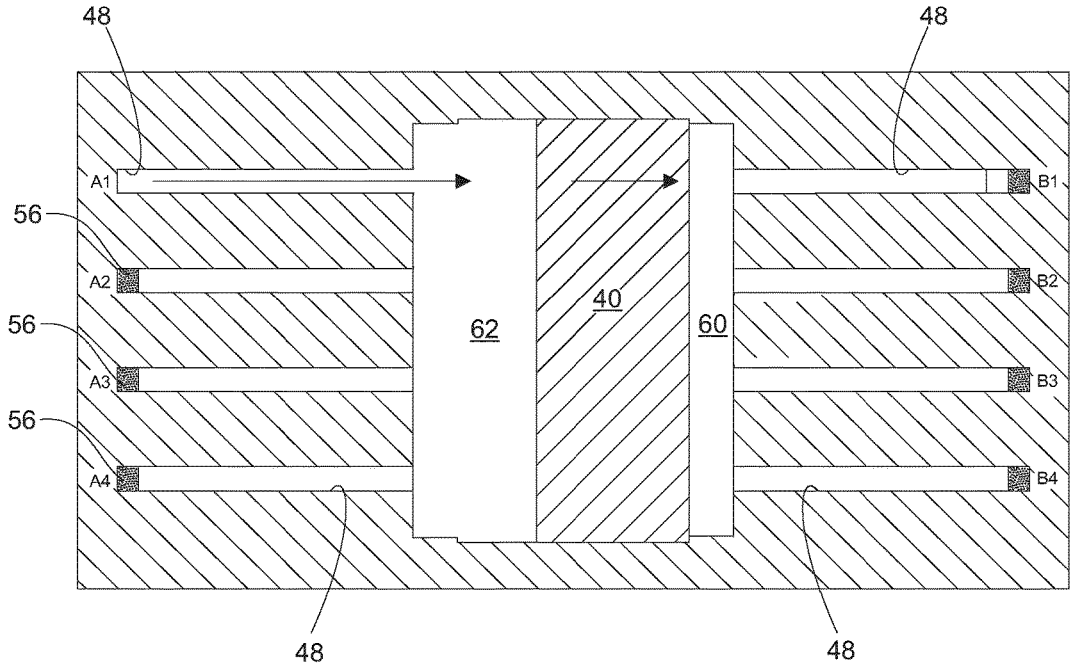

In an embodiment without rods, as shown schematically in FIG. 11, the combustion chambers 48 have the terminal end 54 and the open end 68. Ignition of the propellant 56 therein results in gases and heat expanding rapidly from the open end, the gases expanding into the current combustion chamber 60 having sufficient force to cause the sleeve 28 to shift without the need for push rods 58. Further, the bidirectional piston 40 seals against the housing 20 to seal the combustion chamber 60.

In either case, as a result of the larger amount of propellant 56 required for shifting the sleeve 28, larger amounts of gas and heat are produced. At such time as the pressure in the compression chamber 62 is sufficiently high that the force produced by the subsequent ignition of propellant 56 in another of the explosives chambers 48 cannot overcome the pressure therein to shift the sleeve and compress the gases therein, no further cycling of the sleeve is possible.

While cycling may be limited, embodiments taught herein are capable of shifting more than once and in embodiments, can shift greater than 3 times which is typically sufficient for normal operational requirements using sleeve assemblies.

Electronics

As best seen in FIGS. 2 and 3, the remote sleeve assemblies 10 further comprise an electronics chamber 76 for housing electronic components E, such as at least one or more of a power source, including but not limited to batteries, signal receivers or sensors to detect activation signals, such as acoustic signals sent from surface to actuate the sleeve 28 to shift and connections to ignition apparatus I therein, such as electronic components to electric ignition apparatus for actuating electrical ignition, or connections from the batteries to mechanical ignitors for actuating mechanical ignition.

In embodiments, such as shown in FIGS. 2 and 3, a single electronics chamber 76 is positioned in a profiled annular electronics gallery 78 in the sleeve, located intermediate the propellant charges 56 for ease of wiring thereto. In this embodiment, the electronics chamber 76, being housed in the sleeve 28, travels axially back and forth with the sleeve 28 as it shifts.

Alternatively, as one of skill in the art would appreciate, if the charges are positioned at terminal ends 54 of the explosive chambers 48, individual electronics chambers 76 can be located elsewhere (not shown) in the sleeve 28, or in the housing 20, as close as possible to the propellant 56. In this embodiment, one electronics chamber 76 can be positioned to ignite propellant in the downhole explosive chambers 48*d* to actuate shifting the sleeve 28 in one direction while a second electronics chamber 76 can be positioned to ignite propellant in the uphole explosive chambers 48*u* to actuate the shifting of the sleeve 28 to the other direction. When positioned in the housing 20, the electronics chambers 76 are stationary with the housing. Additional wiring and communication between the electronics components may be required to co-ordinate firing of the opposing propellant charges if handled by different sensors and ignitors.

Exhaust Gas Chamber

In embodiments, to minimize the effect of pressure building to unworkable levels in the compression chamber 62, it is contemplated that pressure can be vented from the compression chamber 62 to a dump or exhaust chamber 80. The exhaust chamber 80 is typically an annular gallery formed in the sleeve assembly 10, such as annular gallery 49 shown in FIG. 3.

In embodiments, the annular electronics gallery 78 can also be used as the exhaust chamber 80. Generally, means, such as epoxy, are used for protecting the electronics therein from the gases and any residual heat vented thereto. While venting to the wellbore may be possible, sufficient sealing would be required to prevent at least electrical components in the sleeve 28 from contact with wellbore fluids and to address the effect of wellbore pressures on the components of the RO sleeve assembly.

In embodiments, where dimensionally possible, the housing 20 or the sleeve 28 may be profiled and fluidly connected to provide additional volume to the exhaust chamber 80.

Figure 12:
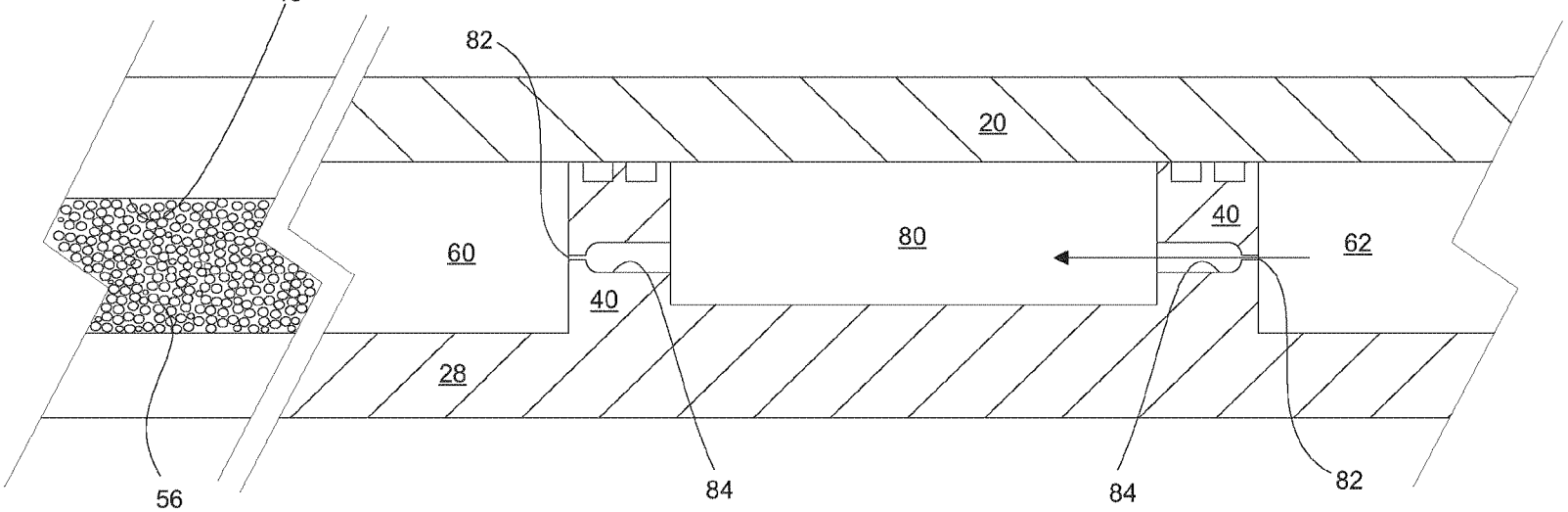
FIG. 12 is a partial sectional view according to FIG. 11, and additional having an exhaust chamber formed in the sleeve piston and bleed holes to combustion and compression chambers on opposing sides thereof.

Having reference to FIG. 12, in an embodiment wherein an exhaust chamber 80 is profiled into the bidirectional piston 40, higher pressure gas from the current compression chamber 62 is continuously bled to the exhaust chamber 80 using a bleed hole 82 and bleed passage 84 fluidly connecting thereto. As the size of the bleed hole orifice is small, the gas and heat entering the combustion chamber 60 cannot leak therethrough quickly enough to diminish the force applied to shift the sleeve 28. As both sides of the bidirectional piston 40 act as the current compression chamber 62, depending upon the direction the sleeve 28 is being shifted, bleed holes 82 and vent passages 84 are formed from both sides of the piston 40 for connecting to the exhaust chamber 80.

Figure 13:
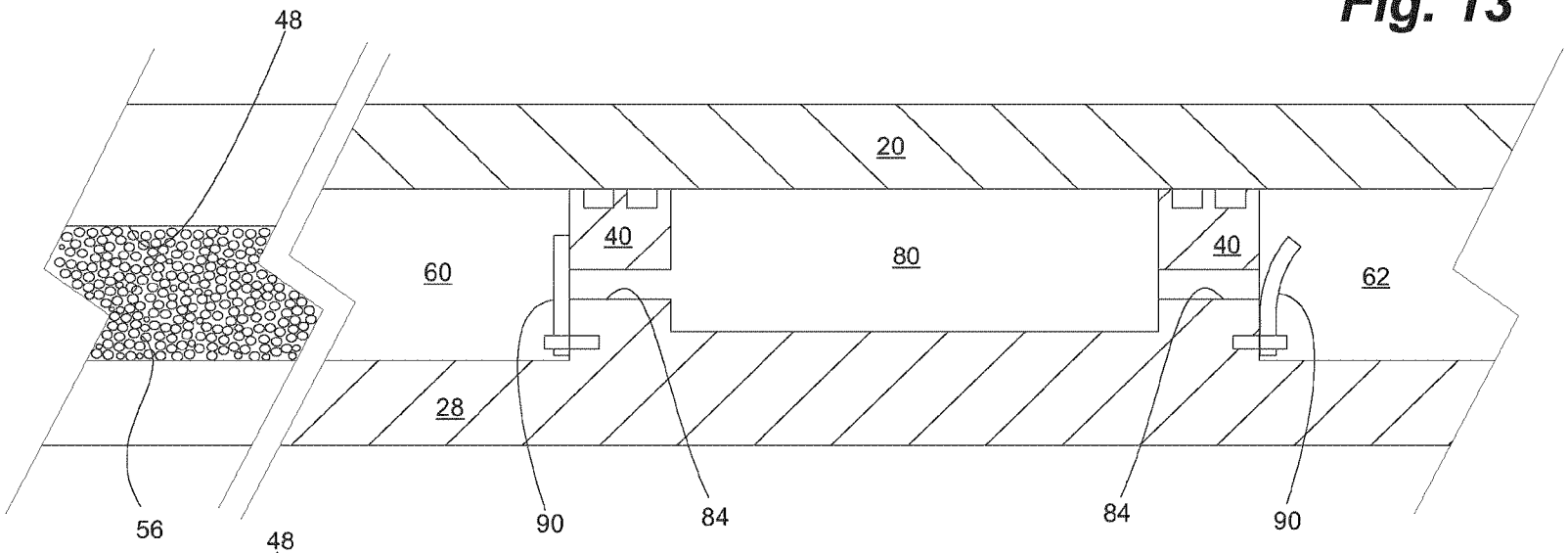
FIG. 13 is a schematic illustration according to FIG. 12, the bleed holes being replaced by flapper valves biased to an open position.

Having reference to FIG. 13, in an embodiment, the bleed holes 82 are replaced using flapper valves 90 that are biased to an open position. At the combustion chamber side, the gases and heat entering into the current combustion chamber 60 therein from the explosive chambers 48 cause the flapper valve 90 to overcome the biasing and close, retaining sufficient gas and heat therein to shift the sleeve 28. On the current compression side 62, continual bleeding of pressure therein from the open flapper valve 90 reduces the pressure to permit additional cycling of the sleeve.

As seen in FIGS. 2 and 3, in the embodiments described, a plurality of seals 86 between an uphole end 88 of the sleeve 28 and the housing 20 and a downhole end 92 of the sleeve 28 and the housing 20 prevent wellbore fluids from entering the exhaust chamber 80 and electronics gallery 78, if located therein. Further, the seals 86, such as O-ring seals, at the uphole end 88 of the sleeve 28, seal the wellbore from the formation.

In embodiments, the sleeve 28 can be retained in the open position or the closed position following shifting thereto. A retainer or detent 94 is overcome in order to shift the sleeve 28 from one position and thereafter, the sleeve 28, when shifted, engages with a detent 94 in the shifted position.

Figures 14A, 14B, 15A, 15B:
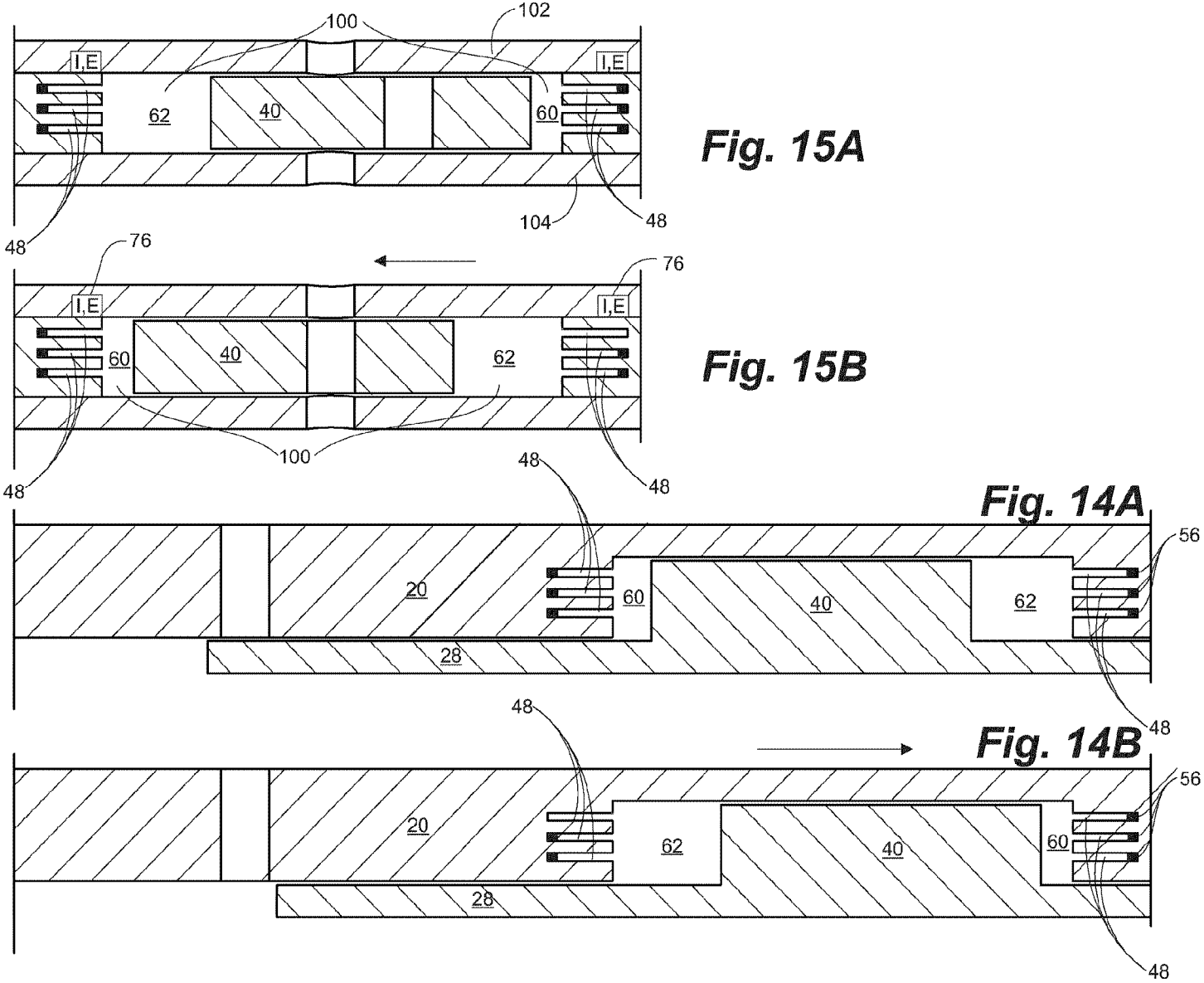
FIGS. 14A and 14B are schematic illustrations of incorporation of a sleeve assembly according to an embodiment taught herein incorporated into a two-part sleeve and shown in a closed position (FIG. 14A) and an open position (FIG. 14B)
FIGS. 15A and 15B are schematic illustrations of incorporation of a sleeve assembly according to an embodiment taught herein incorporated into a three-part sleeve and shown in a closed position (FIG. 15A) and an open position (FIG. 15B)

As one of skill will recognize, embodiments taught herein using push rods 58, or without push rods 58, are not limited to a two-part sleeve assembly configuration and can be used with a variety of sleeve assembly configurations, including but not limited to, a three part sleeve, such as the OptiPort™ sleeve assembly, previously mentioned. FIGS. 14A,B and 15A,B are provided to illustrate schematically, an embodiment taught herein incorporated into a 2-part sleeve assembly (FIG. 14A,B) in the closed (FIG. 14A) and open (FIG. 14B) positions and a three-part sleeve assembly (FIG. 15A, B) in the closed (FIG. 15A) and open (FIG. 15B) positions.

Choice for positioning of the electronics chamber 76 in the three part-assembly 10 may be limited as a result of dimensional restrictions in the annular space 100 between an outer member 102 and the inner member 104, which houses the axially moveable sleeve 28. Thus, it is likely such a configuration will require individual electronics chambers 76 positioned in the outer member 102 and wired to respective of the uphole and downhole explosive chambers 48*u*, 48*d*, one for shifting the sleeve 28 in one direction and one for shifting the sleeve 28 in the other direction.

As previously described, ignition of each of the plurality of uphole and downhole explosive chambers 46*u*,46*d* is controlled using the unique activation codes which are delivered from surface as described above. One or more than one of the uphole chambers 46*u* or one or more than one of the downhole chambers 46*d* can be ignited at substantially the same time to provide sufficient force to shift the sleeve 28 in the desired direction. When the sleeve assembly 10, such as at the sensors therein, receives the unique code, the ignition apparatus I, such as an electronic or mechanical ignitor, is powered to ignite the explosive propellant 56 in the selected one or more chambers 46.

Applicant has determined that use of explosive propellant 56 of a small grain size, such as about 0.030 in. in diameter, reduces the need to precisely tailor the propellant to the system as would be the case with a larger grain propellant, such as about 0.368 in. in diameter.

Testing

In testing, to determine whether relatively small grain size propellant was capable of producing the magnitude of force required to shift a sleeve, Applicant observed that in a chamber having a volume of 0.101 $in^3$, a length of 2.05 in and an area of 0.049 $in^2$, a pressure of about 149126 psi therein could be generated. This would result in a force of about 7340 lbs. The force that can be generated was determined to be sufficient to overcome the combination of a shear screw, having a shear pin strength of 1000 lbs and a friction force of about 100 lbs, such as created by seals between the sleeve and the housing. Thus, using embodiments taught herein, sufficient force would be generated to release the sleeve from the housing and to shift the sleeve to the open or closed position.

In further testing, Applicant calculated the magnitude of pressure and net force in chambers A and B on opposing sides of a bidirectional sleeve piston in a variety of scenarios having different configurations.

Scenario 1

Figure 16:
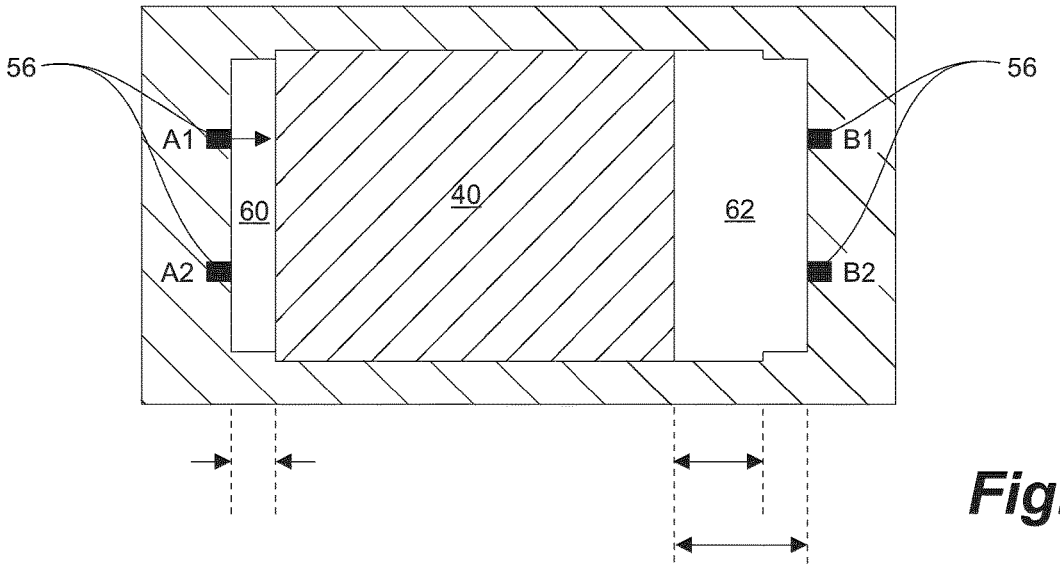
FIG. 16 is a schematic of a configuration of an embodiment taught herein used for testing in scenario 1 described herein.

In a first scenario, the sleeve valve assembly was configured according to the schematic shown in FIG. 16.

Chamber pressures at the end of the strokes in chambers A and B were determined when opposing charges were fired alternately to shift the piston in a first direction, and in a second opposing direction.

The combustion chamber volume for testing was set at 11.25 $in^3$ and the compression chamber volume was set at 30 $in^3$. No additional exhaust volume was provided and no pressure was exhausted from the either chamber. The total shared volume of the two chambers A and B was 41.25 $in^3$. The stroke length was 2.5 in. Fuel weight in each of the chambers A1 to B4 was 3 g, which was the equivalent of a total system fuel weight of 24 g. For comparison purposes and assessment of safety, the total fuel weight was compared to that of a stick of dynamite weighing about 190 g. The total fuel weight used was therefore about $\frac{1}{8}^{th}$ the weight of a stick of dynamite.

The results calculated for Scenario 1 are shown below in Table A

TABLE A

| | | | | | | Direction of shift | |
|---|---|---|---|---|---|---|---|
| | System | Chamber A | | Chamber B | | Net | Net |
| Shot | resting P (psi) | P (psi) start | P (psi) end | P (psi) start | P (psi) end | force lbf (end) | force lbf (end) |
| A1 | 20 | 1911 | 484 | 20 | 79 | 14185 | 3039 |
| B1 | 86 | 86 | 340 | 1983 | 502 | 14321 | 1222 |
| A2 | 152 | 2086 | 528 | 152 | 600 | 14504 | −538* |
| B2 | | | | | | | |
| A3 | | | | | | | |
| B3 | | | | | | | |

As can be seen, the system configured as shown schematically in FIG. 16, was only capable of shifting the sleeve twice, once in each direction (A1,B1) and thereafter there was insufficient force capability to shift a third time (A2). This configuration demonstrates that sufficient force to shift the sleeve is created using embodiments taught herein. Even where the system is limited to a small number of cycles, the ability to directly and relatively simply shift the sleeve is useful in operational situations, such as in a toe sub, which may require a single shift of the sleeve to open the ports and potentially to shift a second time to close the ports. Further, in certain other operational situations, the ability to shift a sleeve only a small number of cycles is very useful.

Scenario 2

Figure 17:
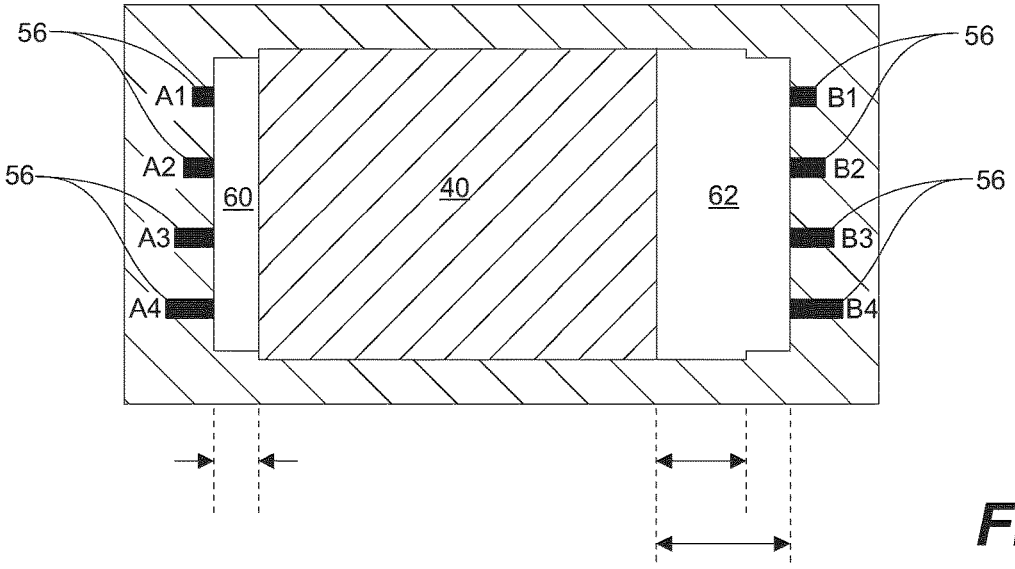
FIG. 17 is a schematic of a configuration of an embodiment taught herein used for testing in scenario 2 described herein.

In scenario 2, the configuration of the test unit, as shown in FIG. 17, was essentially the same as in scenario 1, however the amount of fuel weight was incrementally increased in each successive charge fired so as to maintain a minimum of 3000 lbf at the end of each stroke. The overall system fuel weight was 117 g which is approximately ½ a stick of dynamite for comparison purposes only.

Results calculated for scenario 2 are shown in Table B below:

TABLE B

| | System | Chamber A | | Chamber B | | Direction of shift Net | Net |
|---|---|---|---|---|---|---|---|
| Shot g | resting P (psi) | P (psi) start | P (psi) end | P (psi) start | P (psi) end | force lbf (end) | force lbf (end) |
| A1 3 | 20 | 1911 | 484 | 20 | 79 | 14185 | 3039 |
| B1 4.5 | 86 | 86 | 340 | 2945 | 746 | 21440 | 3048 |
| A2 7 | 185 | 4725 | 1197 | 185 | 730 | 37047 | 3498 |
| B2 10 | 339 | 339 | 1338 | 7017 | 1777 | 50086 | 3294 |
| A3 14 | 558 | 10290 | 2607 | 558 | 2203 | 72990 | 3027 |
| B3 19.5 | 865 | 865 | 3415 | 15197* | 3850 | 107491 | 3260 |
| A4 26 | 1293 | 21894* | 5546 | 1293 | 5105 | 154504 | 3309 |
| B4 33 | 1863 | 1863 | 7355 | 30684* | 7772 | 216160 | 3133 |

As can be seen the additional fuel weight added to successive chambers permitted increased numbers of shift cycles, however the total charge weight was significant over the 8 shift cycles and may be unacceptable in certain operational situations. Additionally, as can be seen where asterixed, the internal pressures after 6 cycles became unacceptably high. This embodiment provides additional cycling, which if limited to a number of cycles at which the pressures are acceptable, is capable of meeting most operational requirements.

Scenario 3

Figure 18:
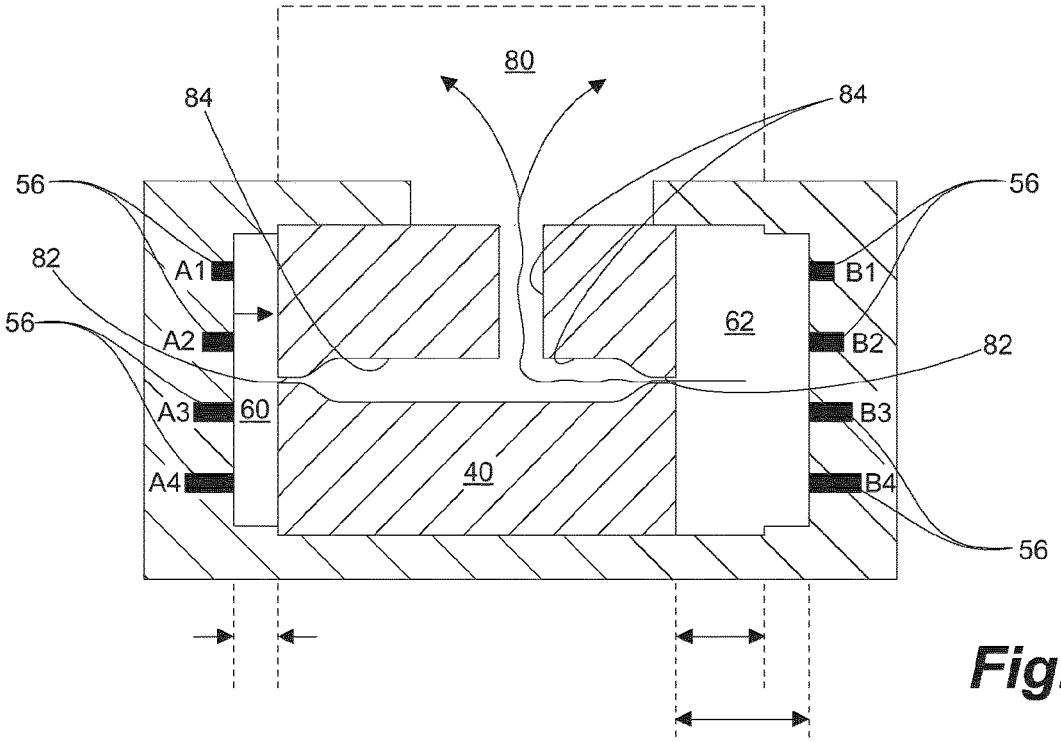
FIG. 18 is a schematic of a configuration of an embodiment taught herein used for testing in scenario 3 described herein.

In scenario 3, the configuration of the test unit, as shown schematically in FIG. 18, was similar to that of scenarios 1 and 2 however the amount of fuel, while incrementally increased in each successive charge fired, was lower in each charge than in scenario 2 so as to maintain a minimum of 3000 lbf at the end of each stroke. An additional volume of 100 $in^3$, for a total shared volume of 141.25 $in^3$, was included to simulate use of an exhaust chamber. Further bleed holes and vent passages, such as shown in FIG. 12, are formed such as in the sleeve piston for venting pressure from the compression side of the piston. The total fuel weight was greater than scenario 1, but significantly less than in scenario 2 at 40.75 g.

Results calculated for scenario 3 are shown in Table C below:

TABLE C

| | System | Chamber A | | Chamber B | | Direction of shift Net | Net |
|---|---|---|---|---|---|---|---|
| Shot g | resting P (psi) | P (psi) start | P (psi) end | P (psi) start | P (psi) end | force lbf (end) | force lbf (end) |
| A1 3 | 20 | 1911 | 484 | 20 | 79 | 14185 | 3039 |
| B1 3.5 | 39 | 39 | 154 | 2247 | 569 | 16563 | 3115 |
| A2 4 | 61 | 2592 | 657 | 61 | 241 | 18981 | 3118 |
| B2 4.5 | 87 | 87 | 343 | 2946 | 746 | 21442 | 3021 |
| A3 5.25 | 116 | 3472 | 879 | 116 | 458 | 15166 | 3161 |
| B3 6 | 150 | 150 | 592 | 4011 | 1016 | 28957 | 3179 |
| A4 6.75 | 188 | 4564 | 1156 | 188 | 742 | 32817 | 3104 |
| B4 7.75 | 231 | 231 | 912 | 5299 | 1342 | 38011 | 3228 |

As can be seen, the inclusion of the additional exhaust volume for exhausting pressure from the compression chamber, permits additional cycling of the sleeve without building undesirably high internal pressure, which may be dangerous in a downhole environment. Further, the amount of explosive charge required is at an acceptable weight to safely operate the system downhole. The additional cycling of the sleeve in this embodiment is sufficient for most, if not all, operational requirements. Dimensional availability to add the exhaust chamber, such as in an annular gallery or elsewhere in the tubular string with appropriate vent passages thereto, is generally available and contemplated in embodiments disclosed herein.

Scenario 4

Figure 19:
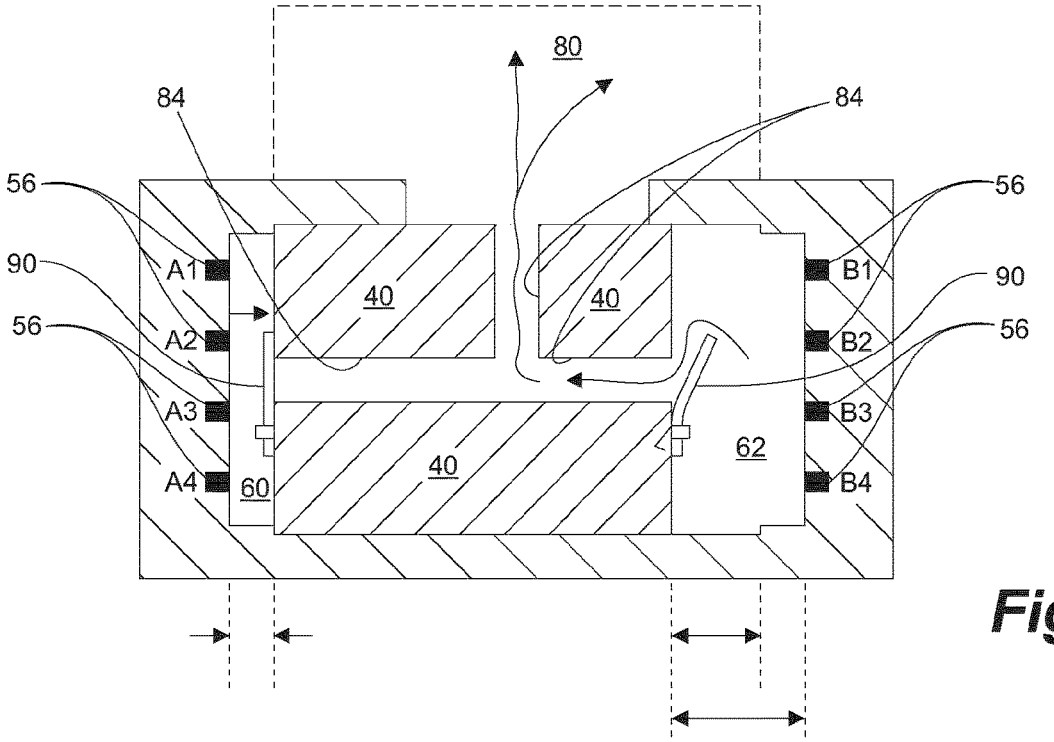
FIG. 19 is a schematic of a configuration of an embodiment taught herein used for testing in scenario 4 described herein.

In scenario 4, the configuration of the test unit, as shown schematically in FIG. 19, comprises a combustion chamber volume of 7.5 $in^3$ and a compression chamber volume of 26.25 $in^3$. An additional volume of 100 $in^3$ was provided to simulate the additional of an exhaust chamber. The total shared volume was 133.75 $in^3$. The amount of fuel weight was maintained at 3.25 g in each charge, so as to maintain a minimum of 3000 lbf at the end of each stroke. The total fuel weight, similar to that in scenario 1, was 26 g. A flapper valve, such as shown in FIG. 13, was added in place of the bleed holes of scenario 3 to isolate the combustion chamber during combustion and to vent the compression chamber to the additional volume during combustion.

Results calculated for scenario 4 are shown in Table D below:

TABLE D

| | System | Chamber A | | Chamber B | | Direction of shift Net | Net |
|---|---|---|---|---|---|---|---|
| Shot g | resting P (psi) | P (psi) start | P (psi) end | P (psi) start | P (psi) end | force lbf (end) | force lbf (end) |
| A1 3.25 | 20 | 3129 | 542 | 20 | 116 | 23314 | 3912 |
| B1 3.25 | 42 | 42 | 243 | 3142 | 544 | 23256 | 3765 |
| A2 3.25 | 64 | 3163 | 548 | 64 | 370 | 23244 | 3627 |
| B2 3.25 | 86 | 86 | 497 | 3188 | 552 | 23266 | 3494 |
| A3 3.25 | 108 | 3217 | 557 | 108 | 624 | 23315 | 3366 |
| B3 3.25 | 130 | 130 | 751 | 3248 | 562 | 23383 | 3241 |
| A4 3.25 | 152 | 3281 | 568 | 152 | 878 | 23467 | 3120 |
| B4 3.25 | 174 | 3316 | 574 | 174 | 1005 | 23563 | 3000 |

As can be seen, in Scenario 4, with the addition of the exhaust volume and the flapper valve, the sleeve can be cycled at least 8 times without building internal pressures that are unacceptable. Further, the amount of fuel required is lower than Scenario 3, which did not include the flapper valve. The additional cycling of the sleeve in this embodiment and the relatively low fuel weight required is sufficient for most, if not all, operational requirements.

Scenario 5

Figure 6A:
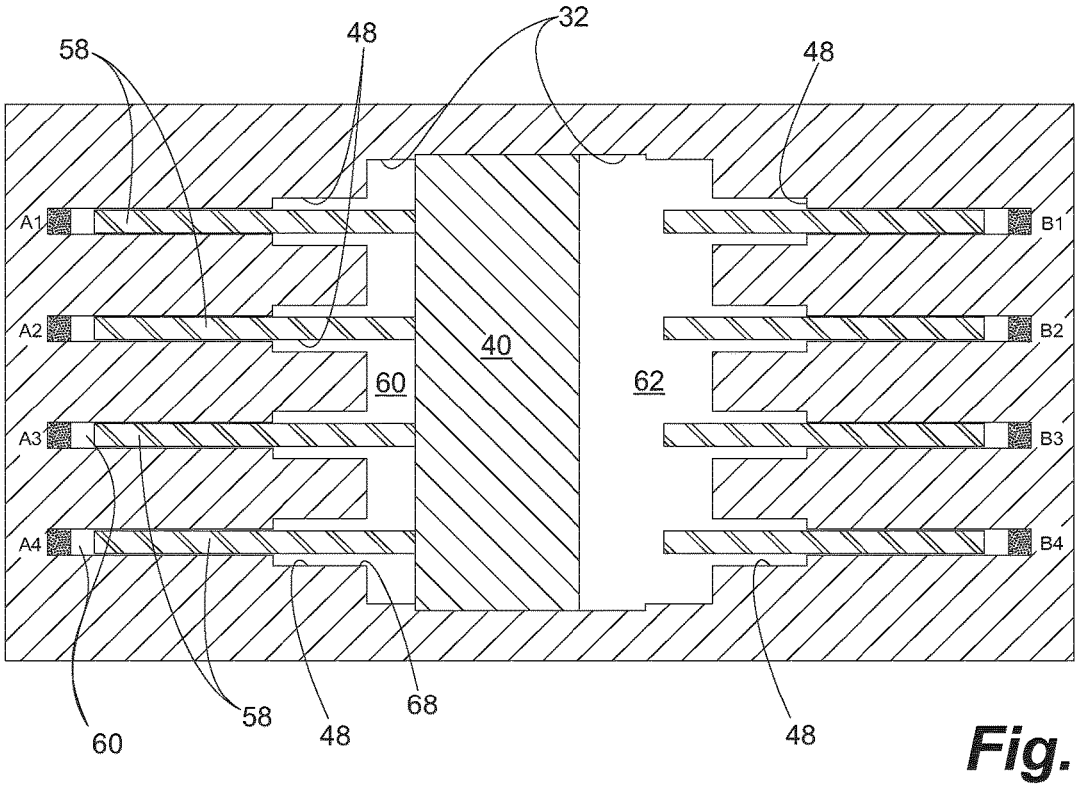
FIGS. 6A and 6B are rollout schematic according to FIGS. 2 and 3, illustrating an embodiment wherein the rods in the explosive chambers are not fixed to the housing and the explosive propellant is sandwiched between a closed end of the explosive chambers and the rod.
Figure 6B:
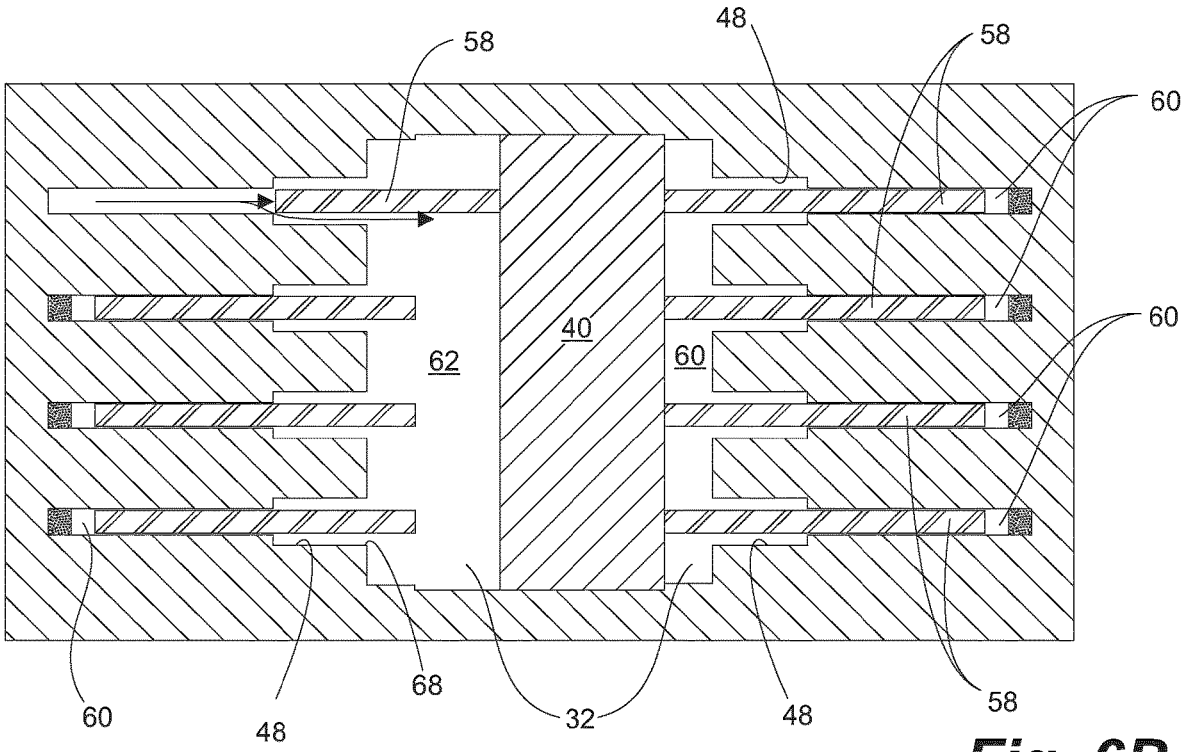

In an embodiment utilizing push rods, such as shown schematically in FIG. 6, pressures were calculated for a configuration defined in Table E shown in FIG. 20. Applicant arbitrarily selected the dimensions and geometry of the chambers having reference to the embodiment using rods. Applicant arbitrarily selected the maximum push force required to shift the sleeve 28 to be 2454.5 lbf, taking into consideration the particular geometry and the additional force required to overcome a detent and any seal friction present. The combustion chamber 60 containing the propellant is sandwiched between the closed end of the explosives chamber and the rod and the compression side is on the opposing side of the sleeve piston.

As can be seen, pressures were calculated for each of 6 shifts in compression chambers having decreasing volumes as a result of decreasing lengths. Further, back pressure and force to shift the piston back, which returns the rods into the spent chambers, compressing whatever gases are therein were also calculated.

It is clear that sufficient force is generated in this example to shift the sleeve back and forth 6 times, without increasing the pressures to undesirable levels. Further, it is clear that different geometries are possible with adjustments being made in chamber volume to achieve a plurality of shift cycles.

What is claimed is:

1. A remoted operated sleeve assembly comprising:

a tubular housing having a bore therethrough and ports therein for fluidly connecting the bore to outside the housing and a radially outwardly extending sleeve recess formed intermediate the housing;

a sleeve axially moveably supported in the housing, for shifting between blocking the ports and opening the ports, and forming an annular space therebetween;

a radially outwardly extending bidirectional sleeve piston formed on the sleeve and extending into the annular space into the sleeve recess;

a first chamber formed in the annular space on one side of the sleeve piston and a second chamber formed in the annular space on an opposing side of the sleeve piston;

a first circumferential arrangement of a plurality of explosive chambers, in fluid communication with the first chamber, and a second circumferential arrangement of a plurality of explosive chambers, in fluid communication with the second chamber, each of the plurality of explosive chambers having a charge of propellant therein; and a sensor in the sleeve assembly for receiving a coded signal for actuating ignition of one or more of the charges of propellant in the first or second circumferential arrangement of the plurality of explosive chambers, wherein one of the first or second chambers has a volume smaller than a larger volume in the other, the smaller volume chamber forming a combustion chamber and the larger volume chamber forming a compression chamber and wherein the signal is coded to actuate ignition of one or more of the charges of propellant in the circumferential arrangement of explosive chambers in fluid communication with the combustion chamber, ignition creating at least expanding gas therein for directly acting on the sleeve piston for shifting the piston and the sleeve attached thereto in the direction of the compression chamber; and wherein shifting the sleeve and sleeve piston in the direction of the compression chamber causes the combustion chamber to increase in volume to become a current compression chamber and the compression chamber to decrease in volume to become a current combustion chamber for a subsequent ignition of one or more of the charges of propellant on the opposing side for shifting the sleeve in the opposing direction.

2. The remote operated sleeve assembly of claim 1 wherein the first and second circumferential arrangements of the plurality of explosive chambers are formed in the bidirectional sleeve piston, on opposing sides thereof, the explosive chambers further comprising:

rods fixed to the housing at uphole and downhole ends of in the sleeve recess and protruding axially therefrom into the explosive chambers, the explosive chambers being axially moveable over the rods as the sleeve is shifted; and terminal ends of the explosive chambers being located in the sleeve piston and having the propellant therein, wherein the combustion and compression chambers are formed in the explosive chambers between the rods and the terminals ends thereof; and when ignited, the at least expanding gases in the combustion chamber act within the explosive chambers between the terminal end and the rod for directly propelling the sleeve piston and sleeve to shift.

3. The remote operated sleeve assembly of claim 1 wherein the first and second circumferential arrangements of the plurality of explosive chambers are formed in the bidirectional sleeve piston, on opposing sides thereof, and wherein the combustion and compression chambers are formed in the explosive chambers.

4. The remote operated sleeve assembly of claim 1 wherein the first and second circumferential arrangements of the plurality of explosive chambers are formed in the housing, on opposing sides of the bidirectional piston.

5. The remote operated sleeve assembly of claim 1 further comprising:

an ignitor actuated by the coded signal sensed by the sensor for igniting the propellant.

6. The remote operated sleeve assembly of claim 4 wherein each explosive chamber further comprises:

a terminal end in the housing and an open end in fluid communication with the first or second chamber;

a rod, axially moveable within the explosive chamber and having a first end protruding from the open end of the explosive chamber into the first or second chamber, wherein the propellant charges are located between the terminal end and a second end of the rod therein forming the combustion chamber and wherein the first end abuts the sleeve piston on a combustion side of the sleeve piston so that when the propellant is ignited, the rod is propelled for directly shifting the sleeve piston toward the compression chamber on the opposing side.

7. The remote operated sleeve assembly rod of claim 6 further comprising:

a sacrificial seal for sealing about the rod in the explosive chamber, the seal being destroyed by the gas and heat upon ignition of the propellant charge.

8. The remote operated sleeve assembly of claim 1 further comprising an exhaust chamber fluidly connected to the compression chamber for venting thereto.

9. The remote operated sleeve assembly of claim 8 wherein the compression chamber is fluidly connected to the exhaust chamber through a bleed hole and bleed passage.

10. The remote operated sleeve assembly of claim 8 wherein the compression chamber is fluidly connected to the exhaust chamber through a valve biased to an open position.

11. The remote operated sleeve assembly of claim 10 wherein the valve is a flapper valve.

12. The remote operated sleeve assembly of claim 8 wherein, when the compression chamber becomes a combustion chamber after shifting the piston, the biasing is overcome by the expanding gas to close the valve.

13. The remote operated sleeve assembly of claim 12 wherein the valve is a flapper valve.

* * * * *